US009328446B2

(12) United States Patent
Plata Amarillas et al.

(10) Patent No.: US 9,328,446 B2
(45) Date of Patent: May 3, 2016

(54) CENTRIFUGE METHOD WITH RINSE

(75) Inventors: Santiago Alonso Plata Amarillas, Queretaro (MX); Erick Flores Islas, Corregidora (MX)

(73) Assignee: MABE, S.A. DE C.V., Queretaro (MX)

( * ) Notice: Subject to any disclaimer, the term of this patent is extended or adjusted under 35 U.S.C. 154(b) by 823 days.

(21) Appl. No.: 12/712,313

(22) Filed: Feb. 25, 2010

(65) Prior Publication Data

US 2011/0099724 A1 May 5, 2011

(30) Foreign Application Priority Data

Feb. 27, 2009 (MX) ..... MX/a/2009/002331

(51) Int. Cl.

| | |
|---|---|
| ***D06F 33/02*** | (2006.01) |
| ***D06F 35/00*** | (2006.01) |
| ***D06F 37/40*** | (2006.01) |
| ***D06F 37/36*** | (2006.01) |
| ***D06F 39/08*** | (2006.01) |

(52) U.S. Cl.

CPC ..... *D06F 35/005* (2013.01); *D06F 33/02* (2013.01); *D06F 37/40* (2013.01); *D06F 39/083* (2013.01)

(58) Field of Classification Search

CPC ..... D06F 35/005; D06F 33/02; D06F 37/40; D06F 39/083; D06F 2236/06; D06F 2236/08

USPC ..... 8/137

See application file for complete search history.

(56) References Cited

U.S. PATENT DOCUMENTS

| | | | | |
|---|---|---|---|---|
| 3,003,090 | A | 10/1961 | Nyhouse | |
| 3,546,786 | A | 12/1970 | Jacobs | |
| 3,640,098 | A | 2/1972 | Eastall | |
| 4,235,085 | A | 11/1980 | Torita | |
| 4,782,544 | A | 11/1988 | Nystuen | |
| 4,843,671 | A * | 7/1989 | Hirooka et al. | 8/159 |
| 4,856,301 | A | 8/1989 | Broadbent | |
| 4,916,768 | A | 4/1990 | Broadbent | |
| 5,127,243 | A | 7/1992 | Babvin | |
| 5,325,677 | A | 7/1994 | Payne | |
| 5,335,524 | A * | 8/1994 | Sakane | 68/12.04 |
| 5,341,452 | A | 8/1994 | Ensor | |
| 5,398,298 | A | 3/1995 | Ensor | |
| 5,596,889 | A | 1/1997 | Guerra | |
| 5,606,877 | A | 3/1997 | Hashimoto | |
| 5,890,247 | A * | 4/1999 | Erickson et al. | 8/158 |
| 6,241,782 | B1 | 6/2001 | VandeHaar | |
| 6,247,339 | B1 | 6/2001 | Kenjo | |
| 6,505,369 | B1 | 1/2003 | Weinmann | |
| 6,553,596 | B2 * | 4/2003 | Kim et al. | 8/159 |
| 6,691,359 | B2 | 2/2004 | Park et al. | |
| 6,826,932 | B2 | 12/2004 | Sonoda et al. | |
| 6,871,370 | B2 | 3/2005 | Choi et al. | |
| 7,299,515 | B2 | 11/2007 | Oh et al. | |
| 2008/0229517 | A1 * | 9/2008 | Amarillas et al. | 8/159 |

FOREIGN PATENT DOCUMENTS

| | | |
|---|---|---|
| EP | 1911869 | 4/2008 |

* cited by examiner

*Primary Examiner* — Amina Khan

(74) *Attorney, Agent, or Firm* — Terry M. Sanks, Esq.; Beusse Wolter Sanks & Maire, PLLC

(57) ABSTRACT

A centrifuge method and a rinse method to avoid sudsing in a vertical axis washing machine which contains, among others a basket within a tub, an agitator or propeller or impulsor mechanically coupled to a motor, a spraying means and a drain pump, the method comprising the steps of:

a. turning on the motor until the basket reaches a medium speed (mS);
b. turning off the motor, when the basket reaches mS and until the basket reaches a minimal speed in which gravity force is greater than the centrifuge force exercised by the rotation of the basket;
c. turning on the motor until the basket reaches a maximum speed; and
d. turning off the motor when the basket reaches the maximum speed after a predetermined time and until reaching a final speed (fS).

15 Claims, 15 Drawing Sheets

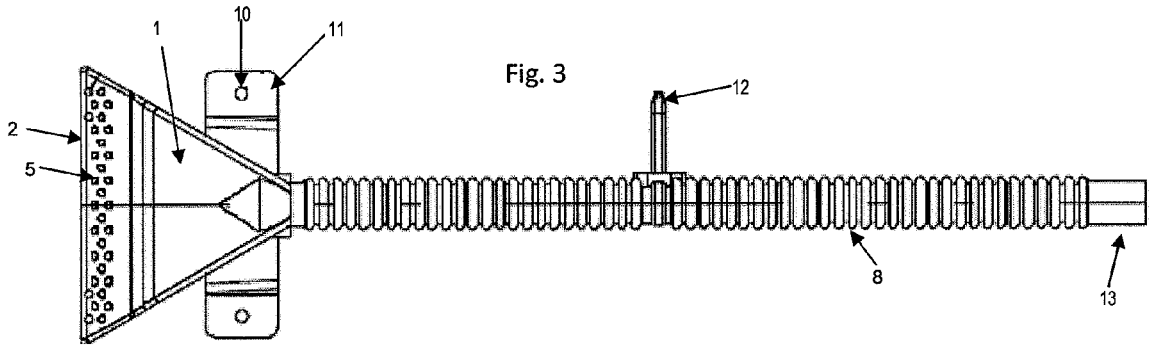
Fig. 3
Fig. 3 A
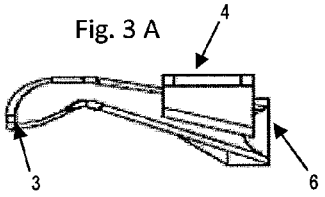

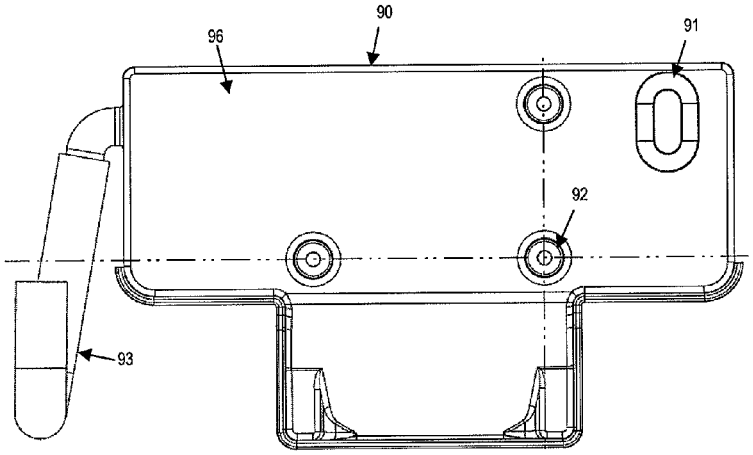
Fig. 6
Fig. 6A
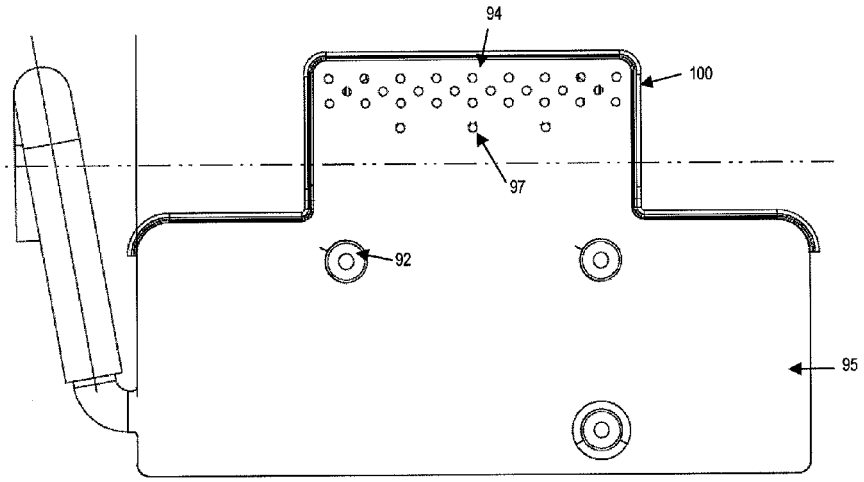

CENTRIFUGE METHOD WITH RINSE

RELATED APPLICATIONS

This application claims priority from Mexican application Serial No. MX/a/2009/002331 filed Feb. 27, 2009, which is incorporated herein by reference in its entirety.

FIELD OF THE INVENTION

The present invention refers to a centrifuge profile (method) with rinse, to maximize elimination of a detergent in a washing machine, and more particularly, a centrifuge profile (pattern) with ecological rinse, using subsequently a washing phase.

DESCRIPTION OF RELATED ART

The present invention provides a centrifuge profile with ecological rinse for a high efficiency textile washing system. The proposed centrifuge profile, which is carried out after the washing phase, initiates an acceleration by means of energizing the motor of a washing machine, said motor is controlled by an electronic circuit that may be an electronic card, which may be a micro-controller or even a memory; the above-mentioned acceleration, called centrifuge ramp is carried out to an intermediate speed, the motor being controlled and sensed through a sensor hall or a sensor of the speed type, an optical sensor, a digital sensor, an encoder, etc.

Said sensed speed reaches a specific level, being in this instant the de-energization of said motor, obtaining the basket an inertia speed resultant of the spin by centrifuge of the textiles within said basket, called over-shoot.

Said basket, which reduces its speed until reaching cero an almost cero speed, has a predetermined rest time which is sensed by the electronic circuit that will later again energize the motor, giving the start to a second centrifuge ramp until reaching a the same or similar speed to the above mentioned, provided by the energized motor, sensed and controlled by the electronic circuit. The motor is later de-energized, having a rest period as the above mentioned, controlled by the electronic circuit; said centrifuge ramps are carried out at least once.

The number of repetitions is predetermined by the annular space between the tub and basket, as well as by the amount of textiles introduced in the basket, the amount of water that the tub may contain, and the quantity and type of textiles within the washing machine.

These centrifuge ramps or pre-ramps play an important roll in the performance of the subsequent centrifuge ramps, having the end of limiting the generation of washing liquor foam, which may generate the appearance of the physical phenomena called "sudsing".

Said physical phenomena of sudsing, consists of excessive generation of foam, wherein said foam fills the annular space between the inner wall of the tub and the outer wall of the basket, stops said basket during centrifuge, since said physical phenomena of sudsing causes that the friction force between both walls to be a friction force so high that it demands greater energy from the motor, reaching in occasions to elevate the temperature until opening the security thermal, stopping thus the centrifuge cycle of the washing machine.

The space between the inner wall of the tub and the outer wall of the basket is essential to the disintegration of said washing liquor foam which causes the physical phenomena called sudsing, since a space of less dimension between the above mentioned walls has less space to store the washing liquor foam, producing sudsing in a smaller period of time. Another disadvantage of the less dimension between both walls is the difficulty to disintegrate the washing liquor foam or dilute said washing liquor foam producing a friction between both walls greater than the torque force of the washing machine motor, causing the stop of the washing machine basket. On the other hand, a greater dimension or space between walls achieves a greater foam accumulation space, helping minimize the risk of sudsing generation, however, wasting load space of the washing machine.

Some of the centrifuge methods with rinse for textiles are disclosed in U.S. patent application Ser. No. 12/052,052 with publication No. 2008/0229517, which discloses the introduction of fresh water volumes in time periods. However, this invention prides a rinse method to limit the mistreatment of the textiles, and thus consume a smaller quantity of energy without affecting the performance of the textile rinse.

In said US patent application, in specific during the rinse phase used in a centrifuge phase, a fresh water quantity is introduced towards the tub, pumped and conducted to the upper cover of the tub, which has water spray means towards the textiles, when the basket is in a still position, providing a hydration and saturation of the textiles, to extract the greatest washing liquor quantity from said textiles, which, prior during the washing agitation phase, were saturated with water and detergents.

The centrifuge phase consists in energizing a washing machine motor, accelerating until reaching a maximum speed, achieving that in said centrifuge phase the washing liquor contained in the textiles within the washing machine is extracted in an adequate form, caused by the speed increment of the basket until achieving a maximum centrifuge speed and keeping said speed during a determined time, following step is waiting for the basket to stop so that the load is again sprayed with fresh water in a stand still of the basket, wherein for the second time the textiles are saturated with fresh water to remove the remaining washing liquor in the textiles.

Document U.S. Pat. No. 4,782,544 corresponding to Arne M. Nystuen et al., makes reference to an automatic control method of a washing machine that gives way to washing liquor extraction by means of increasing the speed of the basket. In this document, the basket starts to rotate at a relatively slow speed, which is called an initial speed, in said initial speed, washing liquor is extracted caused by a washing process, and later, having less quantity of washing liquor saturated in the textiles, a second acceleration starts, which is incremental and depends upon the moisture measured by the inertia force of said basket, as well as depending on the textile quantity in said basket, the basket is again accelerated, wherein washing liquor is again extracted, sensing again the resulting inertia of the rotation of the basket, giving way to another speed increase of said basket.

This document discloses an acceleration continuously increased according to the moisture sensed in said basket. Said acceleration is called centrifuge ramp, wherein once the washing liquor is initiated by means of a first centrifuge ramp, the basket reaches a predetermined speed, the basket is decelerated, and accelerated again, initiating a second centrifuge ramp. When reaching the predetermined limit, it is decelerated, to initiate a new ramp, reaching a predetermined limit. Followed by this group of centrifuge ramps without diminishing its speed, a speed increase is started wherein the speed limit is duplicated with regards to the previous, initiating a second group of centrifuge ramps, wherein this second group of centrifuge ramps has a greater speed than the prior, and therefore would still cause the generation of the physical phenomena called sudsing since said greater centrifuge speed in which the ramps again do not diminish its speed, and due to the washing liquor that saturates the textiles that has not yet been totally extracted; a third group of centrifuge ramps is initiated when the second group of centrifuge ramps finishes, this third group of centrifuge ramp increases more the speed of the basket with regard to the second group, simply avoiding sudsing generation between the basket and tub walls of the washing machine, since said high speed achieved by the basket, since said textiles still contain a washing liquor concentration, all this causing that said sudsing generation causes friction amount said component walls such as the basket and tub, wherein the obtained friction is greater than the torque force produced by the washing machine motor. The basket, wherein the textiles, when containing humidity, is continuously increased in its speed until five times, all greater than the prior, until the humidity has been greatly reduced, without caring for the sudsing generation problems caused by the washing liquor that is impregnated to the textiles, as well as the speed increases of said basket, being stopped until achieving a maximum speed of the washing machine, ending thus the centrifuge phase with serious sudsing generation problems.

In U.S. Pat. No. 6,553,596, corresponding to Hyung-Sook Kim et al., a control method is proposed for the washing machine according to the features of the textiles. This washing machine sprays water during the centrifuge phase is executed along with a draining phase, these parameters are intermittently carried out in a pre-established period of time, as well as the time in which a parameter is carried out in a pre-established time, wherein this water spray, centrifuge and drain is carried out depending on the textile type that is being washed. Said control method uses a microcontroller, that at its time, controls the spraying as well as the sensing and regulates the variable speed of a motor, which carries out the centrifuge, stopping said motor in a very short time period, likewise, said variable speed motor which has a high cost for the above mentioned features, is of complex use, due to which the cost of the variable velocity motor is considerably high, while the invention herein described has an induction motor, which is of simple implementation and is of low cost in regards to the afore-mentioned variable velocity motor; the induction motor is accelerated, while a sensor in charge of monitoring the speed, when a predetermined speed is reached, de-energizes the motor until reaching a cero velocity, limiting the sudsing generation. A disadvantage found in this washing machine and its control method: the deterioration of the textiles is not controlled since said control method executes different centrifuge speeds in a washing cycle that at its time increases the centrifuge speed, without said method allowing the control of the motor to achieve cero, keeping a constant acceleration of the motor increasing the washing liquor foam generating the sudsing phenomena.

U.S. Pat. No. 5,596,889 corresponding to Lawrence E. Guerra et al., discloses a washing machine which carries out a sudsing reduction cycle generated by the washing liquor, said cycles are executed by a control circuit having a motor activation which accelerates the basket sufficiently to agglomerate, due to the rotation force, the textiles to the basket wall, continuing with a second rotation force greater than the preceding, when increasing said velocity overcoming the mean velocity achieved by the washing machine, sudsing is generated since the textiles are still saturated with washing liquor, in said phase with said speed increase, said washing liquor is also drained, even so, the basket is rotating, thus while in this condition there exists the possibility of sudsing generation, the motor is energized until reaching a target speed in the ramp (on the contrary an event has occurred that makes the basket to stop be it by sudsing or by system unbalance, in this case the controller should send signals to the different actuators that the washing machine in deep rinse mode to solve the sudsing problem and try to settle the cloth load), when the motor is de-energized the basket reduces its speed to a minimum different to cero, limiting the possible time period so that the washing liquor generated by these centrifuge ramps has sufficient time so that the pump evacuates said washing liquid stored in the tub, wherein the tub has a lower receptacle in which water or washing liquor are stored so that in a later step they are drained. In a later phase to the above mentioned, a third rotation force in which fresh water is applied to initiate a centrifuge phase at maximum speed, the remaining washing liquor in the textiles is diluted. A greater number of additional centrifuge ramps may be carried out an undetermined number of occasions until reaching a last centrifuge ramp at maximum speed, which will be kept for a predetermined time period extracting the remaining washing liquor in the textiles, ending thus the washing phase and being the clothes prepared for the rinse phase.

BRIEF SUMMARY OF THE INVENTION

After the deep wash cycle in a washing machine, the textiles are saturated with washing liquor with a high detergent concentration, with which filth is eliminated from the textiles, wherein this washing liquor has to be drained to extract the greatest quantity of filth, detergents and dirty water.

This filth quantity is extracted in great part from the textiles by means of a centrifuge, achieving with this dehydrating the cloth load. This dehydration stage in a washing machine, consists of the basket rotation, which creates a centrifuge force, wherein in consequence, the textiles adhere to the basket wall, water is mixed with detergent forming a washing liquor, said washing liquor is separated from the textiles by displacement of the same through the textile fibers caused by the compacting and volume reduction of the textiles, same which are caused by the centrifuge force applied in the basket and articles therein, at the same time reducing the washing liquor content. The displacement of the washing liquor contained in the textiles in the basket occurs in the first layers of the textile fibers, wherein the washing liquor slides from the basket towards the tub caused by a centrifuge force applied to the basket and by the compacting and volume reduction of the textiles, wherein by draining, the washing liquor is accumulated in the lower part of the tub, later being drained by a pump, that at its time expels the washing liquor from the washing machine.

Said foam is formed in the annular inner space formed between the outer basket wall and the inner tub wall, wherein this free space between walls is called annular space. In the annular space said foam is agglomerated, producing a physical phenomena called sudsing, consisting in excessive generation of foam between the above-mentioned walls, causing the stop of the basket by the friction exercised by the accumulation of washing liquor foam between said walls, and wherein the washing machine motor, is stopped by a sudsing phenomena since the friction force generated by the sudsing is greater than the torque force of the washing machine motor.

Furthermore, said annular space above mentioned, is one of the most important factors in washing liquor foam generation, that is, the annular space is capable of diminishing or increasing sudsing generation. If the annular space is smaller in dimension, the possibility of generating sudsing is greater, therefore a greater number of centrifuge ramps should be carried out. That is, in a smaller annular space, it is most likely that the extracted washing liquor from the textiles during the centrifuge ramps is sufficient to fill a section of said annular space; if this occurs, the odds that sudsing is generated is high, accumulating the foam in said annular space and exercising friction between the above-mentioned walls, thus leading to the stop of the basket rotation, since said generated friction force is greater than the torque force of the motor, and as a consequence an excessive over-heat of the motor and thus the stop of the cycle. Therefore, a greater number of centrifuge ramps is required to avoid the possibility of sudsing generation resultant from the washing liquor foam. In case there exists a greater annular space, the risk of sudsing generation decreases, however, the effective space to wash is reduced, or the space needed for the washing machine increases.

An alternate embodiment of the centrifuge phase of the present invention is rehydrating the textiles based on a predetermined volume of fresh water fed from the water intake of a public network, this last feeding directly the shower, which may use a sprayer. Said sprayer, which is usually located in the tub cover or in the lower part of the tub cover, has the function of spraying the textiles within the basket. The fresh water coming from the public network, is sprayed through a spraying means that has in its end a shower with holes by which the liquid will be sprayed; a second spraying option is through a spraying ring which has an entry tube by which liquid is admitted to later be distributed in said spraying ring, this through some holes in the body of said spraying ring, will expel said fresh water; and a third option is through a deflector placed in the tub cover, which is in charge of spraying when a spurt is ejected with certain pressure in such a manner that when hitting the deflector, the water is scattered over the textiles. All these options have the restriction that they only work if the pressure is greater than 15 kg×cm$^2$ (213 psi).

Yet another alternative embodiment of the present invention is hydrating the textiles with a predetermined quantity of admitted water, stored in the tub of said washing machine, said water lacks the pressure and abundance applied from the public supply network, and will be circulated by means of a pump located in the lower part of said washing machine, which will send fresh water through a feeding duct placed in the lateral wall of the tub, said feed duct will lead the fresh water to the upper part of the tub and basket, where it will be sprayed by means of spraying means consisting in that its upper part it has a shower with orifices by which said water will be expelled in the textiles contained in the washing machine basket; another spraying means is a spraying ring, which is fed similar to the above spraying means, reaching said fresh water an entry tube, distributing said fresh water in said spraying ring, that will later expel said fresh water through the spraying holes placed in the lower part of said spraying ring, said fresh water will be expelled over the textiles contained in said washing machine basket. A third option is through a deflector placed in the tub cover that is in charge of spraying when a spurt is ejected with certain pressure in such a manner than when hitting the deflector the water is scattered over the textiles. All these options have the restriction that they will only work if the pressure is greater than 15 kg×cm$^2$ (213 psi).

In a later phase to the centrifuge, called "ecological rinse", a rinse step is initiated, wherein a predetermined amount of fresh water is admitted towards the tub, used to dilute the washing liquor remaining in the textiles, said fresh water that is admitted, is used with different spraying means along with the different ecological rinses, said fresh water that is admitted is pumped and lead to the upper part of the tub, wherein it reaches a spray means with which it will be sprayed to the textiles located within the basket, so that the textiles are uniformly humidified and saturated with fresh water, facilitating the dilution of the washing liquor, to achieve this, the basket is rotated to predetermined positions obtaining a uniform spray. Alternatively, the predetermined fresh water quantity may be directly sprayed by means of the spraying means, over the textiles located within the basket.

This centrifuge period, water admission, spray, combined with the basket rotation, are repeated until obtaining an optimal extraction of the remaining washing liquor in the textiles, obtaining a considerable saving of energy, since later centrifuge periods at maximum speed are avoided, as well as a considerable savings in water, since the washing machine only admits once a minimal quantity of fresh water for the rinse of said textiles.

The centrifuge with ecological rinse is carried out when the basket is at full stop, said basket increases its speed to a medium velocity, wherein said medium velocity may be a third part of the maximum velocity of the centrifuge ramp, which could have an over-shoot of this medium velocity caused by the acceleration provided to the induction motor of the washing machine to later de-energize said motor allowing to lower the speed to cero or a speed close to cero, wherein the basket reaches a minimum speed in which gravity force is greater than the centrifuge force exercised by the rotation of said basket, stopping the spraying for an instant, and later the spraying is repeated until admitting a predetermined amount of fresh water allowing an optimum rinse. Later a centrifuge with ecological rinse is carried out in a predetermined fixed time depending on the amount of textiles within the basket. Likewise, after the spraying, a centrifuge ramp corresponding to a second speed, medium speed oscillating in a speed range of a third part of the maximum speed or elevating until reaching the medium of the pre-established maximum speed in the motor of the washing machine, de-energizing said motor to later initiate a third greater centrifuge ramp, reaching the maximum speed of the washing machine.

In an embodiment of an alternate ecological rinse of the present invention, the basket can be motionless, wherein the textiles are sprayed with fresh water obtaining an optimum soak of said textiles, eliminating a greater quantity of remaining detergent of the washing liquor with which the textiles have been saturated during washing phase, later a centrifuge ramp corresponding to an oscillating medium speed in a range of a third part of the maximum speed or elevating until reaching the medium of the maximum preestablished speed in the motor of the washing machine, de-energizing said motor to later initiate another greater centrifuge ramp, reaching the maximum speed of the washing machine. These fresh water spraying blocks over the textiles, achieve a significant water saving, water saving that in systems that use centrifuge blocks with ecological means of the prior art are not achieved. Furthermore, the performance of the rinse is improved.

Additionally another alternative embodiment to the above mentioned embodiment, wherein the basket is intermittently rotated while the cloth load is sprayed to uniformly hydrate it, after this, the spraying is stopped so that the basket is rotated again, giving place to the basket rotation to at a predetermined angle, repeating these steps until the predetermined minimum quantity of fresh water is admitted and until the basket has rotated between 61 to 301° preferably, to obtain a saturation or hydration of the textiles, reducing or diluting the concentration of the detergent of the washing liquor with which they were saturated. The set of steps above mentioned is adjoined with a dehydration consisting of a pattern of acceleration and deceleration ramps as were above disclosed, which goes from 1 to 5 ramps followed by a maximum speed centrifuge; this step sequence is called a "semi-rinse block". The ecological method consists of at least 1 semi-rinse blocks.

The present invention proves a centrifuge method with ecological rinse for washing machines, with which an important water saving is obtained. Furthermore, when this method is used the consumed energy is economized by the washing machine with regards to other centrifuge methods with rinse disclosed in the prior art.

In the process of application of said centrifuge profile with ecological rinse, a considerable elimination of washing liquor is obtained; furthermore, another advantage of this patter, is that of being robust in textiles loads of an approximate of 161*b*, being the motor of a quarter of a horse, said motor being of one speed between 670 and 710 rpm.

BRIEF DESCRIPTION OF THE SEVERAL VIEWS OF THE DRAWINGS

The particular features and advantages of the invention, as well as other objections of the invention, will be apparent of the following description, taken in connection with the attached figures, which:

FIG. 3 is a front detailed view of a spraying means used in the present invention.

FIG. 3A is a cross-section view of the spraying means of FIG. 3.

FIG. 6 is a detailed upper view of a dosing means.

FIG. 6A is a detailed lower view of the additive dosing means of FIG. 6.

DETAILED DESCRIPTION OF THE INVENTION

Figure 1:
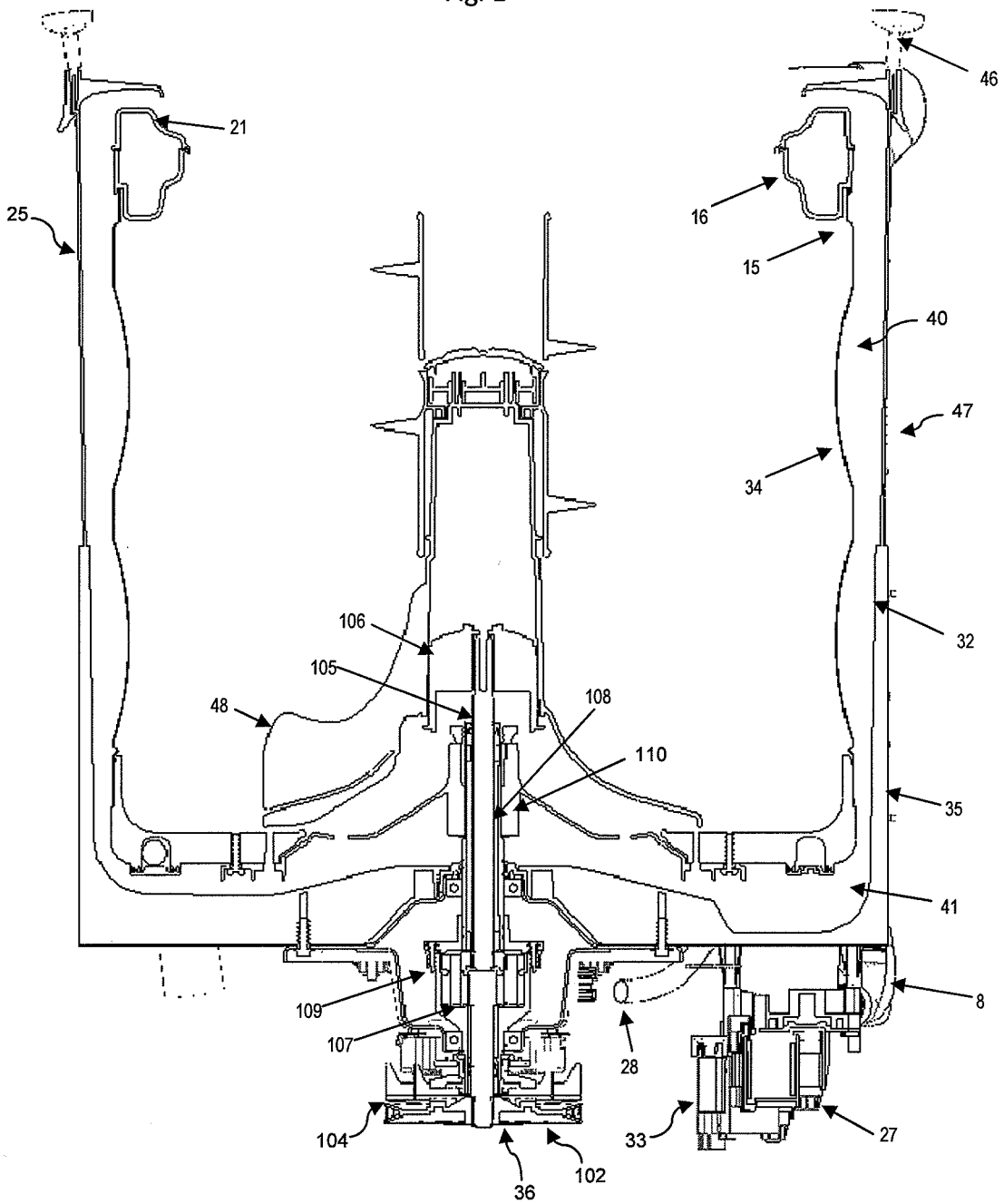
FIG. 1 is a front view of a cross-section of a washing machine.

The present invention is not limited to be used in textile washing machines, rather may be used in other electric appliance, such as any other washing system.

A washing machine 25 usually comprises a cabinet 35, which comprises a tub 32, as well as a basket 34 capable of rotating, in which textiles or articles to wash are introduced. Said washing machine 25 works by means of a motor 33 which moves by means of a pulley and shafts, to an agitator, impulser or propeller 48 or similar. The agitator, impulser or propeller 48 at its time complies with different functions of a work cycle commonly named a washing cycle 52, wherein said washing cycle 52 comprises among others, an ecological rinse phase by spraying 58, with which different washability parameters are used to produce said ecological rinse by spray 58 after the washing cycle 52, which executes some washing parameters within the washing machine 25; said ecological rinse method by spray 58 will obtain an optimum grade of filthy water as well as washing liquor, which saturates the textiles during the washing cycle.

FIG. 1 shows a cross-section of a sub-washing machine 47 that is coupled to the cabinet 35 by means of a suspension 46. The sub-washing machine comprises: a tub 32 to contain used water during the washing cycle 52, as well as used water during the ecological rinse cycle by spray 58; the basket 34 located within the tub 32, wherein the basket has perforated walls to facilitate fluid communication between the inner part of the basket 34 and the washing tub 32, additionally, the basket 34 is capable of containing within the textiles or articles to be washed; and an agitator, propeller, impulsor or similar 48 placed within the basket. The washing machine 25 houses a motor 33 and an impelling system 36, both located in the lower part of the tub 32, which transfer the energy of the motor to the basket 34 and agitator 48, to rotate the basket 34, and, in its case, the agitator or propeller 48 which may rotate relative one of another.

The annular space 40 is that, which is formed between the outer wall of the basket and the inner wall of the tub. In the annular space foam is agglomerated produced by the washing liquor, and, as was mentioned before, produces a physical phenomena called "sudsing", consisting of an excessive generation of foam in the annular space 40, causing the halt of the basket 34 due to the friction exercised by the accumulation of washing liquor foam between said walls, and where the washing machine 25 motor 33 stops since the friction force generated by the sudsing may be greater than the torque force of the washing machine 25 motor 33.

Also, said annular space 40 is one of the most important factors in the generation of washing liquor foam, that is, the annular space is capable of diminishing or increasing sudsing generation. If the annular space 40 is of smaller dimension, the possibility of sudsing generation is greater, therefore a greater number of centrifuge ramps will be carried out. That is, in a smaller annular space, it is more likely that the amount of washing liquor extracted from the textiles during centrifuge ramps is sufficient to fill a section of said annular space; if this occurs, the odds that sudsing occurs is high, accumulating the foam in said annular space and exercising friction between the above mentioned walls, leading to the stop of the basket rotation and as a consequence an excessive heat by the motor and thus the stop of the cycle. In the case that there is a greater annular space 40, the risk of sudsing generation is reduced, however the effective space to wash in is reduced, or the necessary space to occupy by the washing machine 25 is increased.

Figure 2:
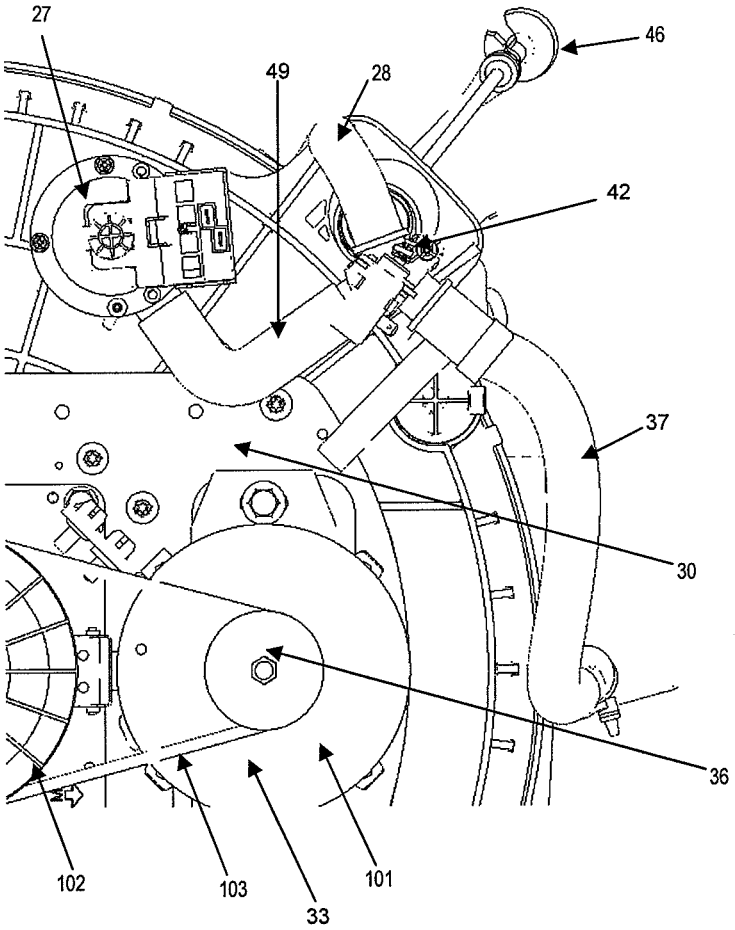
FIG. 2 is a lower partial view of a washing machine.

The impeller system 36 which may be seen in FIG. 2 may be comprised by an motor 33 which transmits energy to an impelling pulley 101, which at the same time transmits energy to a pulley 102 by means of a band 103, the pulley 101 in a preferred embodiment of this invention has an entry shaft to a reduction mechanism 107, which preferably is a planetary gearbox. An alternative embodiment could not contain said reduction mechanism 107 and thus the pulley shaft in its free end would have disposed the coupler 106. The outbound shaft of the reduction mechanism 107, called inner shaft 105 rotates within the hollow shaft 108. Said inner shaft 105 couples in its free end the coupler 106 over which the propeller or agitator 48 is mounted. In its part, the hollow shaft 108 is mechanically coupled to the hub 110 and this at its time is fixed to the lower part of the basket 34.

Said impeller system 36 consists of a coupling system 104 which is preferably coupled between the agitator 48 and pulley 102 depending on its location the specific design parameters of the washing machine.

The referred motor 33 has a speed sensor coupled thereto, preferably a hall effect sensor, which sends a signal to a control system, which has as a component a micro-controller (not shown), which at its time controls the aperture of the valve 9 through a relay (not shown) or any other type of interrupter. Likewise, the micro-controller (not shown), activates the motor through a triac (not shown) or any other type of interrupter, wherein said triac may deactivate the motor 33.

Said sub-washing machine 47 comprises a pump 27, which pumps the water or washing machine found in the tub bottom 41, to a drain duct 28. This drain cycle 56 is executed in the wash cycle and the ecological rinse method 54 by spraying 58. Alternatively, the bidirectional valve 42, may direct water that is found in the tub bottom 41 and is pumped by the pump 27 towards the re-cycling duct 37 and towards the spraying means 1 to spray the textiles being washed within the basket 34.

The control system receives signals coming from the control board of the washing machine, as well as from the pressure sensor, the speed sensor, flow sensor, selection buttons of the selection mode or washing cycle, turn on, stop, water level selector, temperature, among others. Also, the control system sends control signals to the interrupters or drivers of the actuators as such as motor 33, pump 27, bidirectional valve 42, admission valve 9, coupling system 104.

The coupling system 104 has the function of coupling or uncoupling the inner shaft 105 with the hollow shaft 108 so that said shafts 105 and 108 rotate in an independent manner or at unison, being this last case to be able to centrifuge or make that the basket receives energy by means of the impeller system 36 coming from the motor 33, to which from here-onforth will be referred to as centrifuge mode; in the contrary case the impeller system 36 provides energy only to the shaft 105 so that the agitating function may be carried out; this coupling system may be comprised by a solenoid or any other type of actuator which makes the change mechanism to couple or uncouple the referred shafts 105 and 108, or in an alternate embodiment said solenoid or electric actuator is not present, and a floating clutch may be used, which couples or uncouples the shafts 105 and 108 depending on the water level accumulated in the tub 32.

In FIG. 2 the lower part of a washing machine may be seen, which shows the motor 33 and the impeller system 36 (partially shown). The bidirectional valve 42, directs fresh water stored in the tub bottom 41 for the ecological rinse through the re-circulating duct 37 while the liquid flow is closed to the drainage, by means of a duct 49 that joins the pump 27 with the directional valve 9. The bidirectional valve 42, directional of water, washing liquid and filth directs towards the drain hose 28 connected in an exit of the directional valve 9, while the liquid flow is closed to the duct 37. Alternatively, fresh water is admitted by means of a directional valve directly from the water network for the ecological rinse through a feed duct 8 and the fresh water is sprayed directly to the textiles being washed in the basket 34.

In FIGS. 3 and 3A said spray means 1 may be appreciated in detail, the feed duct 8, as well as the shower 2 of said spray means 1. The shower 2 comprises holes 5 which will provide the fresh water to the textiles disposed in the basket 34. The spray means 1, may be fed through the feed duct 8 through the fresh water admission valve 9, wherein said fresh water may come from the public water network. Alternatively, the fresh water coming from the public water network may be stored in the tub bottom 41, and by means of a pump 27, the bidirectional valve 27 and re-circulate duct 37, the fresh water may be pumped to feed the spray means 1.

The spray means 1 has in its upper end 4 a fastening lateral 11, which has in its ends barrels 10 in which fastening means such as screws, pins, nails or any other fastening means that may serve for this purpose, which may or may not be threaded, which will fix the spraying means to the lower part of the cover (not shown) of the washing machine 25. This spraying means 1, has a circular entry in its back part, through which the feed duct 8 will be introduced, which will be fastened to the washing machine 25 tub 32 using a fastener 12. The feed duct 8 in its opposed end 13 is introduced to the valve 9 which will allow the flow of fresh water and will direct the flow of fresh water towards the textiles located in the basket of the washing machine 25.

Figure 5:
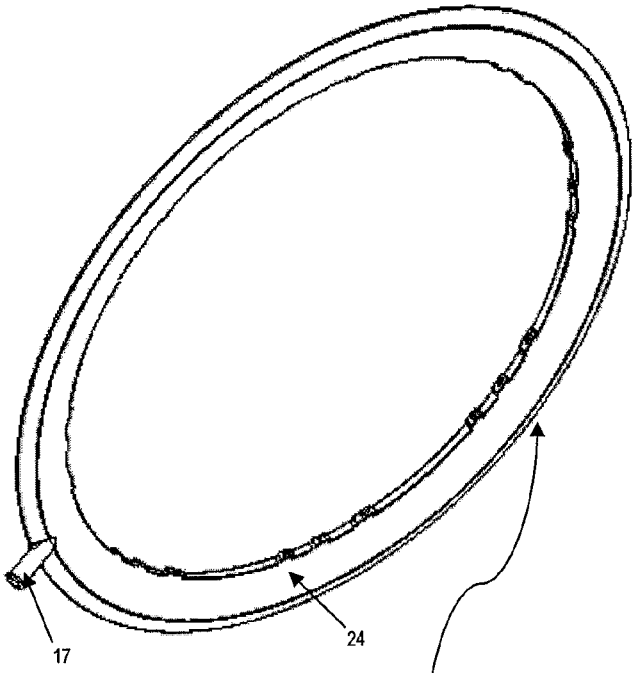
FIG. 5 is an upper conventional perspective view of a spraying ring.
Figure 5A:
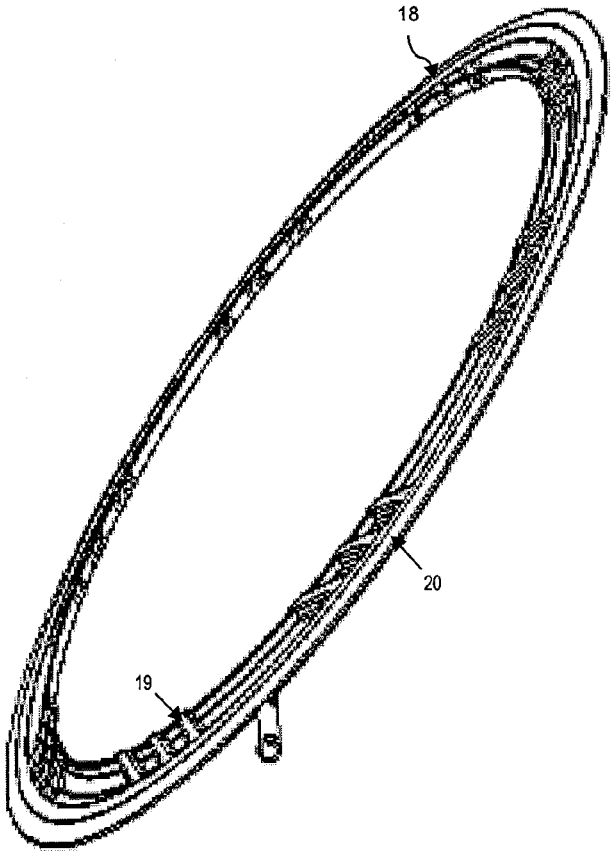
FIG. 5A is a lower conventional perspective view of the spraying ring of FIG. 5.
Figure 4:
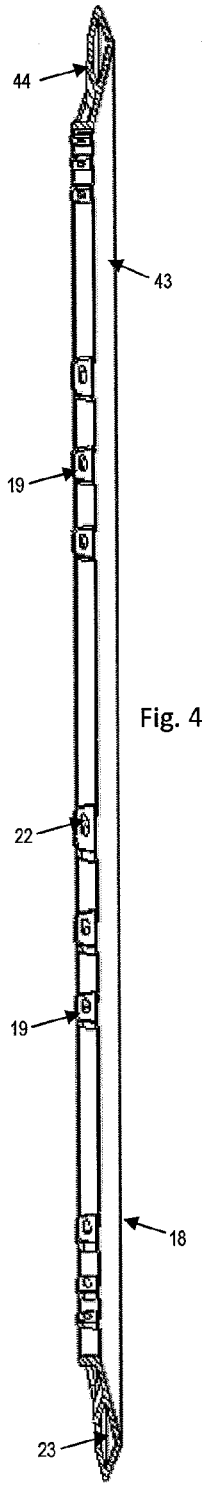
FIG. 4 is a cross-section of a front view of the spraying means.

FIGS. 4, 5 and 5A are views in different angles of a water spray means or any other liquid that serves or has the purpose of washing, rinsing or forming part of the stated washing or rinse cycle, which is used in a washing machine, alternate to the spray means shown in FIGS. 3 and 3A. Said water spray means called spray ring 18 is disposed or mounted in the lower part 15 of the tub cover 16. Said spray ring 18 which has in its lower part an annular compartment called spray chamber 23, formed by an upper wall 43 and a lower wall 44 encapsulating the fresh water within the spray ring 18, said fresh water is received through the feed duct 8 by means of an entry tube 17, and distributed throughout the spray chamber 23, reaching a nozzle 22 which sprays the fresh water within the spray chamber 23 towards the articles disposed in the basket 34. The nozzle 22 of the spray ring 18 has a geometry such, as well as a direction such, to ensure that the textiles are humidified in a uniform manner.

Figure 6B:
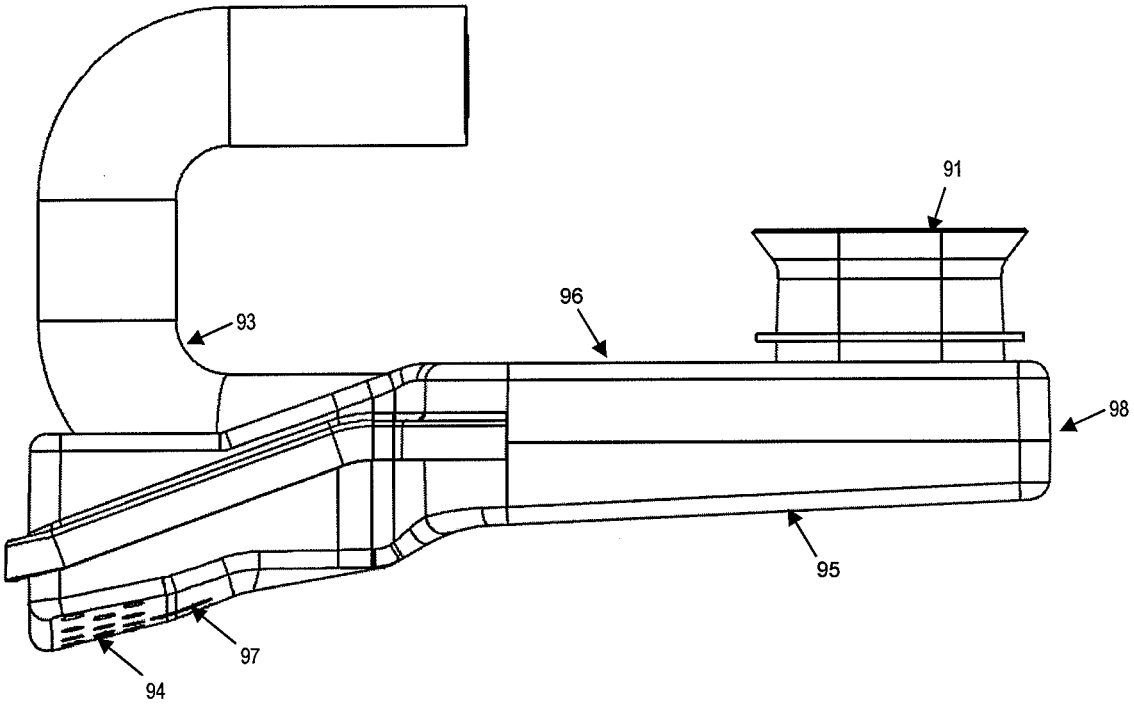
FIG. 6B is a lateral view of the additive dosing means of FIG. 6.

FIGS. 6, 6A and 6B show views of a third alternate spraying means in form of a washing additive dosing device 90, specifically a textile softener dosing device 90 or any other washing additive which has some function in the washing cycle. Said dosing device 90 has the functionality of diluting said washing additives along with water or any other washing liquid.

The dosing device 90 is mounted or disposed in the lower part of an additive dispenser drawer, which at its time, is disposed or mounted in the lower part 15 of the cover 16. Said additive dosing device 90 is formed by a lower wall 95 and an upper wall 96, wherein both parts form an additive deposit 98, which, in one embodiment, stores fresh water or additives which are diluted with fresh water. The deposit 98 is fed through the admission nozzle 91 to later be discharged through the holes 97 through which the diluted softener is drained towards the front part of the dosing means. Said diluted softener is diluted even more by the current coming from the shower 94 (sprayer with an auger), which, is fed with fresh water coming from the public network, or stored water in the tub bottom 41.

The dosing device 90 has the advantage of allowing the admission of the softener both in the washing phase 50 as well as in the ecological phase 54 avoiding in both phases, the deterioration of the textiles caused by the stains of high concentrations of washing additives; contrary case improvements are obtained in the textiles such as softening, freshness and smell in the textiles.

A second embodiment of fresh water admission coming from the public network is through the feed duct 93 through which the fresh water flows, said feed duct 93 is connected to the shower entry 100. Said shower 100 sprays the fresh water through the holes 94 of the sprayer 100, said holes 94 are disposed in the lower wall 95 of the additive dosing device 90, through which fresh water is sprayed with the washing additives coming from the additive deposit which pass through the admission nozzle 91, reaching the deposit 98, which later both are discharged in the basket 34 which contains the textiles.

The additive dosing device 90, which is mounted in the lower wall of the additive deposit, is fastened using fastening means located in the lower wall of said additive deposit 99 (not shown), being these screws, pins, nails or any other fastening means that provides sustainability and firmness to said dosing device 90; the fastening means is inserted in barrels 92 which trespass the upper wall 96, as well as in the lower wall 95 of said dosing device 90.

The additive dosing device 90, along with the additive deposit 99, lowers the additive concentration diluting them in fresh water, said additives are dosified and efficiently sprayed to the textiles within the basket 34, through the holes 94 and through the dripping holes 97. Said holes have a dimension of 0.30 in-0.400 in. Furthermore, the arrangement of said holes and the quantity of holes 2-10 allow the flow of a small amount of already diluted washing additives obtaining a better performance in the washing phase, in the ecological rinse phase 54 and softening the textiles.

As is well known in the art, a complete cycle of a washing machine comprises three stages which are washing, dehydration or centrifuge and rinse. The washing phase initiates when the user introduces the objects to wash in the interior of the basket 34 and the type of textiles, the type of washing cycle to carry out and the temperature are selected; following act, the machine control opens the valve 9 allowing the admission of liquid toward the interior of the tub 32 until achieving a predetermined level, this level may be selected by the user or may be determined in base of the cloth quantity deposited in the basket 34 for example, the method disclosed in U.S. Pat. No. 6,446,291 corresponding to Diaz Fernandez et al. In this moment or prior to, during the agitation step, detergent is added, be it by means of a detergent dispatcher which will drag said detergent towards the tub 32 or the user may directly add it; the agitation of the washing machine 25 starts. After the agitation phase the washing liquor is extracted, for this, the control 45 activates the pump 27 and the washing liquor is directed to the sewage.

A preferred embodiment of the invention, is dehydrating articles deposited in the basket 34 by means of the centrifuge to afterwards give step to the ecological rinse, in an alternative embodiment, a dehydration step may be omitted going directly to the ecological rinse which will be detailed below. In an alternate embodiment, after the ecological rinse 54, a deep rinse may be carried out.

Figure 7:
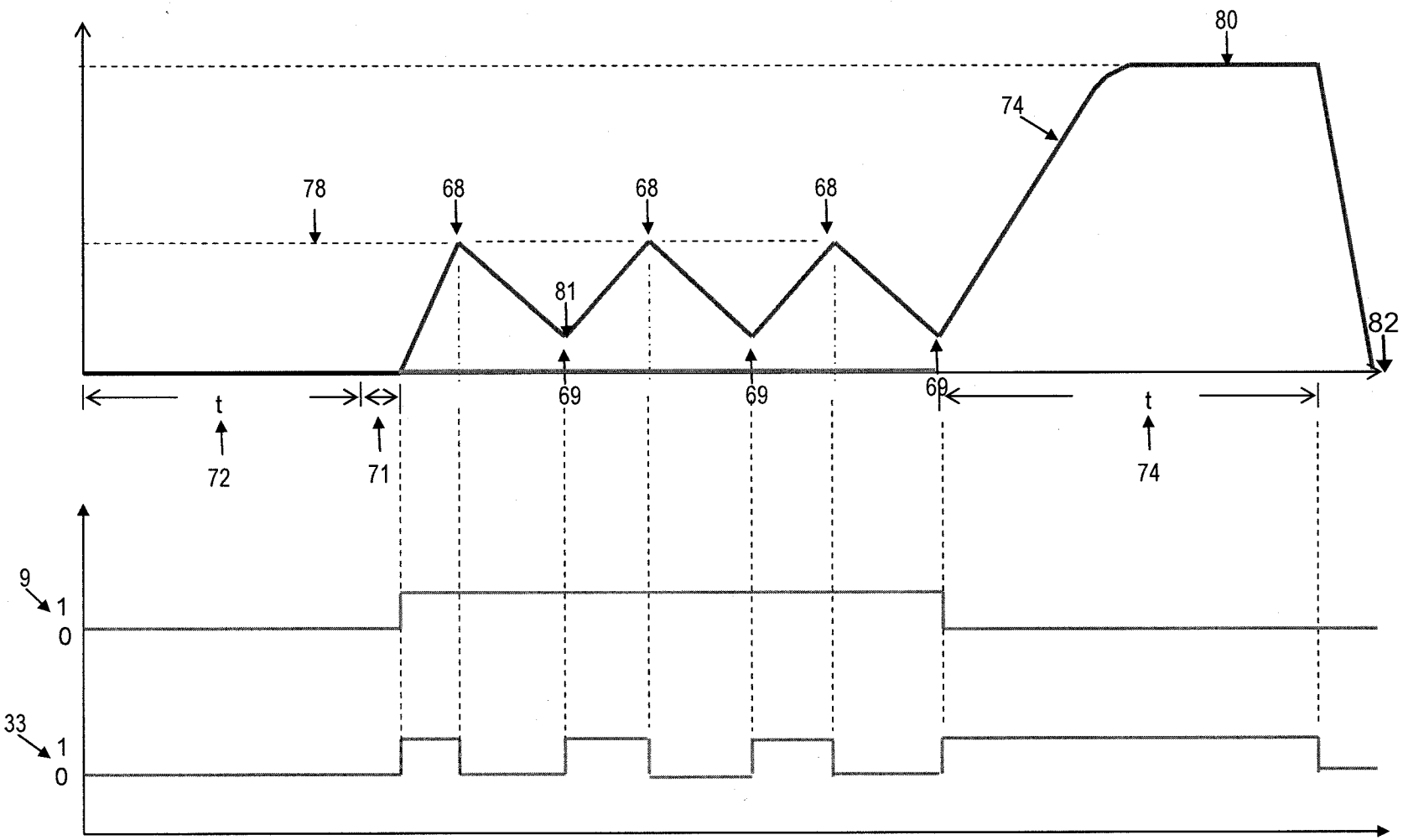
FIG. 7 shows a diagram of the rinse and centrifuge method used in the present invention.

FIG. 7 shows a first preferred centrifuge profile of the present invention. Having finished the agitation phase 72 during the washing phase, the centrifuge process is carried out to the textiles within the basket 34, wherein the washing liquor contained in the tub 32 is drained, with the help of the pump 27 in a time period 71; following act and continuing with the drain pump 27 activated, a first centrifuge ramp 68 is initiated, said centrifuge ramp 68 reaches a medium speed 78 which should oscillate in a range of between 200 rpm to 450 rpm. This is achieved activating the motor 33 until the basket 34 reaches said medium velocity 78 which is sensed by a speed sensor, preferably a Hall Effect sensor, and when said sensor senses that the basket 34 has reached a medium speed 78, the control 45, sends a signal to the motor 33 controller which may be a relay, triac or any other type of interrupter, which deactives the motor 33. Being the motor deactivated the speed decreases until reaching a minimum speed 81, which is a speed such, that the centrifuge force exercised over the textiles by the rotation of the basket 34 is such that it is less than the force of gravity, the minimum speed 81 being in a range of 0 to 180 rpm. Said centrifuge ramp 68 is preferably repeated at least once in said centrifuge profile. The drain pump 27 is in activated state until the last minimum speed ramp. In a later step, just after having finished the last centrifuge ramp 68, and when minimum speed 81 is achieved, the motor 33 is activated and a greater centrifuge ramp 74 is started, which reaches a maximum speed 80 for a predetermined time period, having finished said time period, the control deactivates the motor 33 controller and the drain pump 27. The fact of accelerating the basket 34 until achieving a medium speed 78 to later deenergize the motor 33 limits the foam generation in the annular space 40, thus avoiding the basket 34 stop due to sudsing. This also helps that when the basket 34 slows down less washing liquor is extracted from the textiles which is accumulated in the bottom of the tub 32, since the centrifuge force decreases, giving time to the drain pump 27 to extract the washing liquor that was removed from the textiles, and thus even allowing to use the drain pump 27 in less time, thus causing a smaller energy use.

Figure 8:
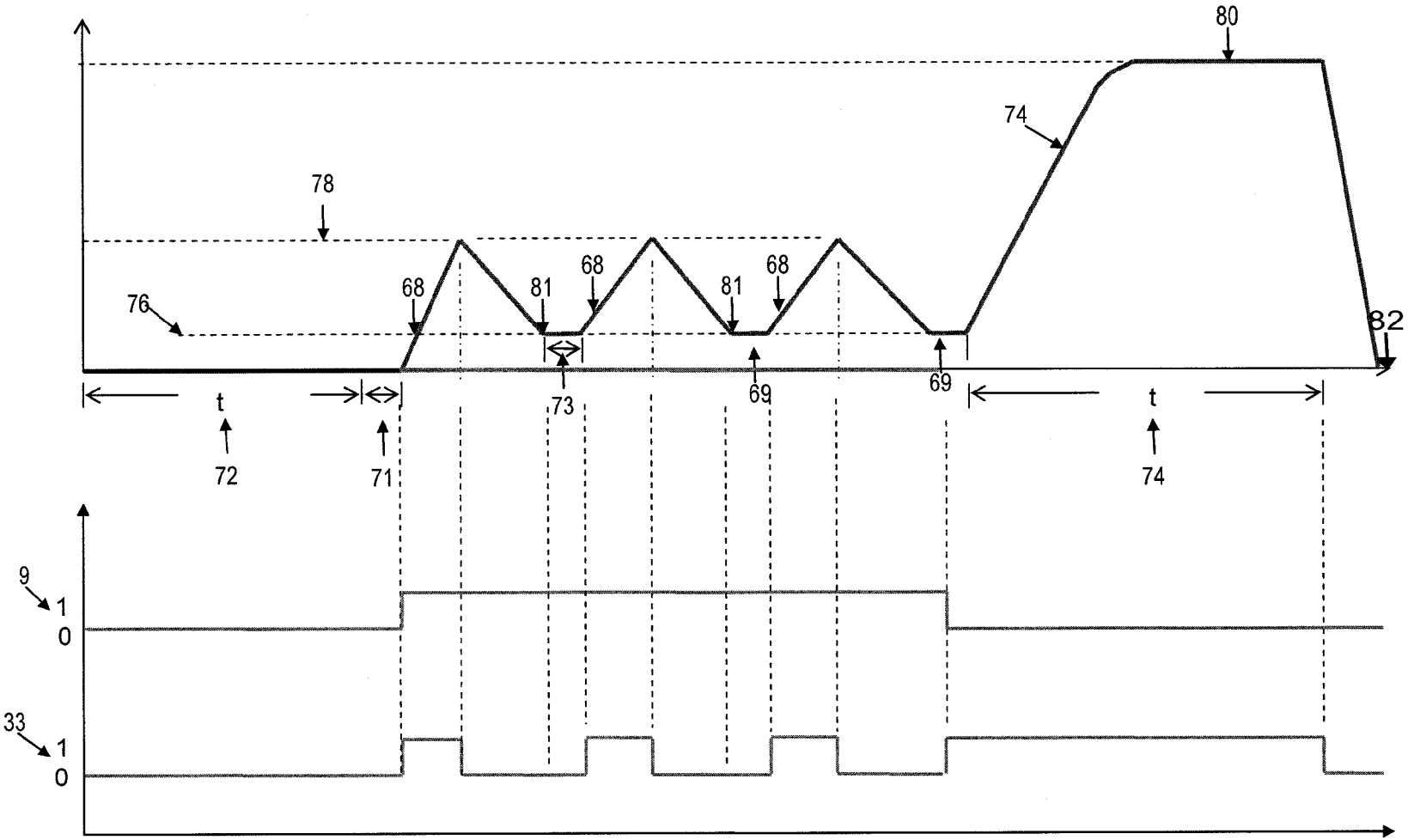
FIG. 8 shows a firs embodiment of a flow diagram of the rinse and centrifuge method of the present invention.

In FIG. 8 a second preferred profile of the present invention is shown. Having finished the agitation phase 72, the textile centrifuge process contained in the basket 34 is carried out, wherein washing liquor contained in the tub 32 is drained with the help of the drain pump 27 in a time period, following act and continuing with the drain pump 27 activated a first centrifuge ramp 68 is initiated. Once the centrifuge ramp 68 is initiated, the basket achieves a medium velocity 78 which should oscillate in the range of 200 rpm to 450 rpm. This is achieved by activating the motor 33 until it reaches said medium velocity 78, later, the motor is de-energized, and the basket 34 speed decreases until reaching a minimal speed 81, which is sensed by a speed sensor, preferably a hall sensor, and when the sensor senses that the basket 34 has reached a medium speed 78, the control sends a signal to the motor 33 controller, keeping said minimal speed 81 constant for a predetermined time period 73, said minimal speed 81 is a speed such, that the centrifuge force exercised over the textiles by the basket 34 rotation is less than the gravity force, the minimal speed 81 being in the range of between 0 to 180 rpm. Once this time period 73 at a minimal constant speed 81 has lapsed, the motor is again accelerated increasing the basket speed again to a medium speed 78. Said centrifuge ramp is repeated at least one time in said centrifuge profile. The drain pump 27 is activated having finished the agitation 72 until the last minimal speed ramp. In a later step, just after the last predetermined time 73, the motor 33 is activated and a greater centrifuge ramp 74 is initiated, which achieves a maximum speed 80 for a predetermined time period, having finished this time period the control de-actives the motor 33 controller and the drain pump 27. Accelerating the basket 34 until achieving a medium speed 78 to later de-energize the motor 33 followed by a predetermined time limits the foam generation in the annular space 40, thus avoiding the basket 34 stop by sudsing, and further an extraction of washing liquor accumulated in the bottom of the tub 32 is granted, thus being able to use a smaller sized drain pump 27.

Figure 9:
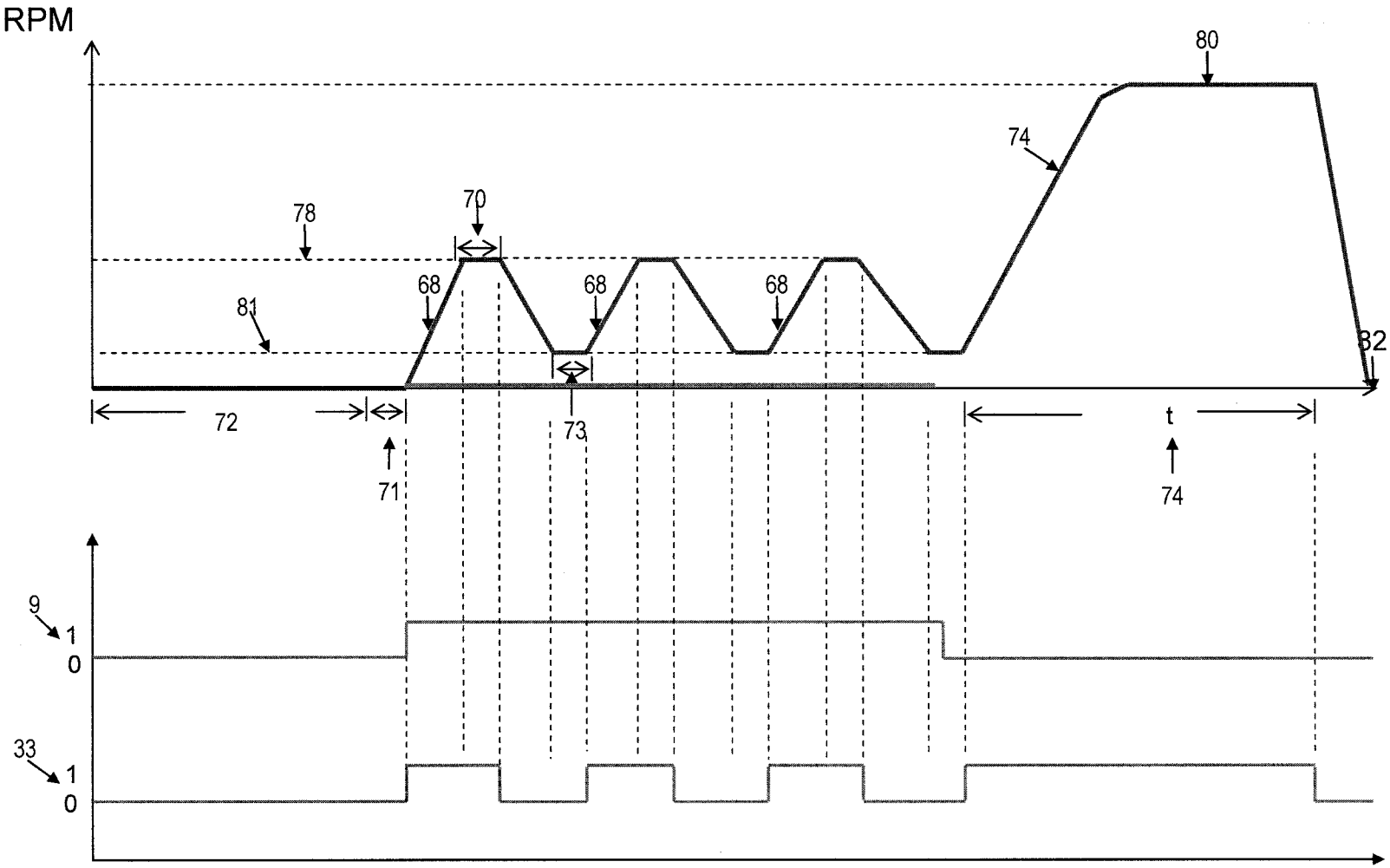
FIG. 9 shows a second embodiment of a flow diagram of the rinse and centrifuge profile of the present invention.

In FIG. 9 a third preferred centrifuge profile of the present invention is shown. Having finished the agitation phase 72, the centrifuge process of the textiles contained in the basket 34, in which the washing liquor contained in the tub 32 is drained, with the help of the drain pump 27 in a time period, following act and continuing with the pump 27 activated, a first centrifuge ramp 68 is initiated. Once the centrifuge ramp 68 is initiated the basket reaches a medium speed 78 which is kept constant for a predetermined period of time, said medium speed is sensed by a speed sensor, preferably a hall sensor sending a signal to the motor 33 controller 45. Said medium speed 78 oscillates in a range between 200 rpm to 450 rpm. Once said constant time period 70 lapses, the motor is de-energized, the basket 34 speed decreases until reaching a minimal speed 81, keeping said minimal speed 81 constant for a predetermined time period 73. Said minimal speed 81 is a speed such, that the centrifuge force exercised over the textiles by the basket 34 rotation is less than the gravity force, the minimal speed 81 being in the range of 0 to 180 rpm. Said centrifuge ramp 68 preferably repeats at least one tine the centrifuge profile. The drain pump 27 is active having finished the agitation 72 until the last minimal speed ramp. In a later step, just after the last predetermined time 73, the motor 33 is activated, a greater centrifuge ramp 74 is initiated, which reaches the maximum speed 80 for a predetermined time period, having lapsed the time period, the control de-activates the motor 33 and the pump 27. Accelerating the basket 34 until reaching a medium speed 78 for a constant speed time period 70, allows having a controlled washing liquor extraction, further to that with said medium speed 78, the centrifuge force is not so great, diminishing textile mistreatment. Later, the motor 33 is de-energized which limits foam generation in the annular space 40, thus avoiding the basket 34 stop by sudsing, even more a washing liquor extraction time accumulated in the bottom of the tub 32 is accumulated being able to use a smaller sized pump 27.

An alternative embodiment of the invention is when the disclosed centrifuge profile ramps of FIGS. 7, 8 and 9 add fresh water to the textiles while the basket 34 rotates, this helps dilute the soap or detergent concentration of the washing liquor avoiding sudsing generation since the fresh water falls in the exposed surface of the textiles located within the basket 34. Said fresh water when passing through the textiles reaches the basket 34 wall due to the centrifuge force, and it its way drags the detergent or soap contained in the textile fibers, diluting thus the detergent concentration of the washing liquor, this already diluted washing liquor is extracted thanks to the holes provided in the basket 34 wall. The diluted washing liquor which reaches the annular space 40 avoids sudsing generation, since a diluted washing liquor is less inclined to generate foam, which leads to a smaller number of centrifuge ramps 68 or a smaller annular space 40. This also eases the ecological rinse, which will be discussed below, since the textiles no longer contain a high detergent concentration in the washing liquor. The addition of fresh water towards the textiles are achieved by the mechanisms: spray means 1 or spray ring 18 or dosing device 90.

Another embodiment of the present invention is when the spraying means mechanism 1 or the spraying ring 18, or dosing device 90 are not directly connected to the valve 9, rather admitting fresh water between the tub 32 and basket 34, accumulating it in the tub bottom 41, to later be pumped by means of a pump 27 towards said spraying means 1, 18 or 90 so that these hydrate the textiles.

Said spraying means 1 which, in this alternative embodiment is not directly connected to the valve 9, said valve 9 is connected to a feed duct 8 which leads fresh water to the space between the tub 32 and basket 34, through the upper space between these two, said fresh water is now accumulated in the tub bottom 32 until reaching a predetermined level. In a preferred embodiment, the pump 27 is connected to a bidirectional valve 42 which is controlled by the electronic control, said bidirectional valve 42 composed by two output holes, one of them leads liquid to the sewage and the other hole is connected to a re-circulating duct 37 that leads the liquid to the upper part of the tub and which, in its free end a spraying means 1 is coupled, the spraying ring 18 or the dosing device 90. The electronic control which directs the bidirectional valve 42 so that this directs the flow of fresh water accumulated in the tub towards the spraying means 1, the spraying ring 18 or the dosing device 90, thanks to the pump 27, causes a spray of fresh water over the textiles. In this embodiment the electronic control activates the pump 27 feeding the spraying means 1, the spraying ring 18 or the dosing device 90 of fresh water for a predetermined time period, this being sufficient to relocate the water in the bottom of the tub 32 over the textiles within the basket 34. In an alternative embodiment to the present invention, the electronic control activates the pump 27, sends the motor 33 a pulse which allows the basket to rotate to a predetermined angle, which oscillates between 30 and 80 degrees, maintaining the pump 27 active for a predetermined time period, which will be called spraying time 87, directing the fresh flow of water towards the spraying means 1 and this at its time humidifies or soakens the textiles placed in a determined section of the basket 34, once concluded the spraying time 87 the operation is repeated until the basket has rotated at least one revolution, this is done with the purpose of relocating the fresh water contained in the tub 32 disposing it in the textiles contained in the basket 34.

Ecological Rinse

Figure 10:
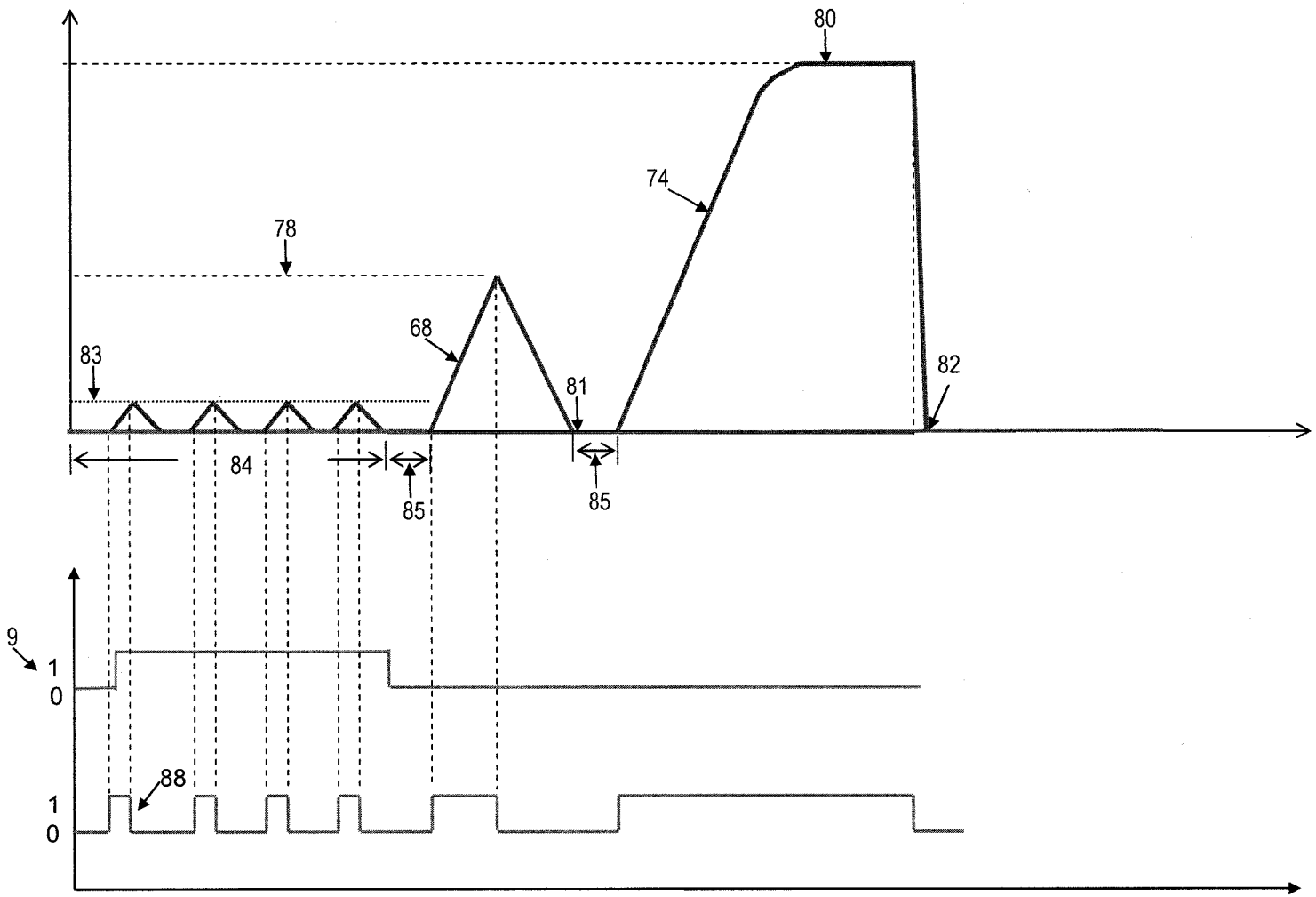
FIG. 10 shows a third embodiment of the centrifuge and rinse profile of the present invention.

FIG. 10 shows an ecological rinse profile 54 of the present invention. Having finished the washing phase, the ecological rinse process is carried out with the textiles within the basket 34, wherein when the valve 9 is activated, admission of fresh water is initiated towards the basket 34, which is sprayed through the spraying means 1 or the dosing device 90. The motor 33 is activated, being the coupling system 104 is centrifuge mode, the pump 27 is activated, said motor 33 makes that the pulley 101 rotates at least one revolution creating a pulse 88, later the motor is de-activated, repeating said steps until the basket 34 rotates at least one revolution, helping soak the textiles contained in the basket 34. Later a centrifuge ramp 68 is initiated, activating the valve 9, activating the motor 33, said centrifuge ramp 68 which achieves a medium velocity, which is sensed by the electronic control, preferably a sensor hall disposed in the motor 33, and which should oscillate in a range of between 200 rpm to 450 rpm. Consecutively, the valve 9 is de-activated, the motor 33 is de-activated reaching a minimal speed 81, the minimal speed 81 being in the range of 0 to 180 rpm. The valve 9 is activated, reaching a drain period 85, when said drain period 85 is finished, the pump 27 is continuously activated. Said mentioned steps may be repeated at least once in said ecological rinse profile 54. In a later step, the motor 33 is activated, the pump is continuously activated and a greater centrifuge ramp 74 is started, which reaches maximum speed 80 keeping said maximum speed 80 for a predetermined time period. Later the motor 33 deactivation is initiated taking the basket to a final speed, until reaching zero rpm, stopping the basket 34 and deactivating the pump 27.

Figure 11:
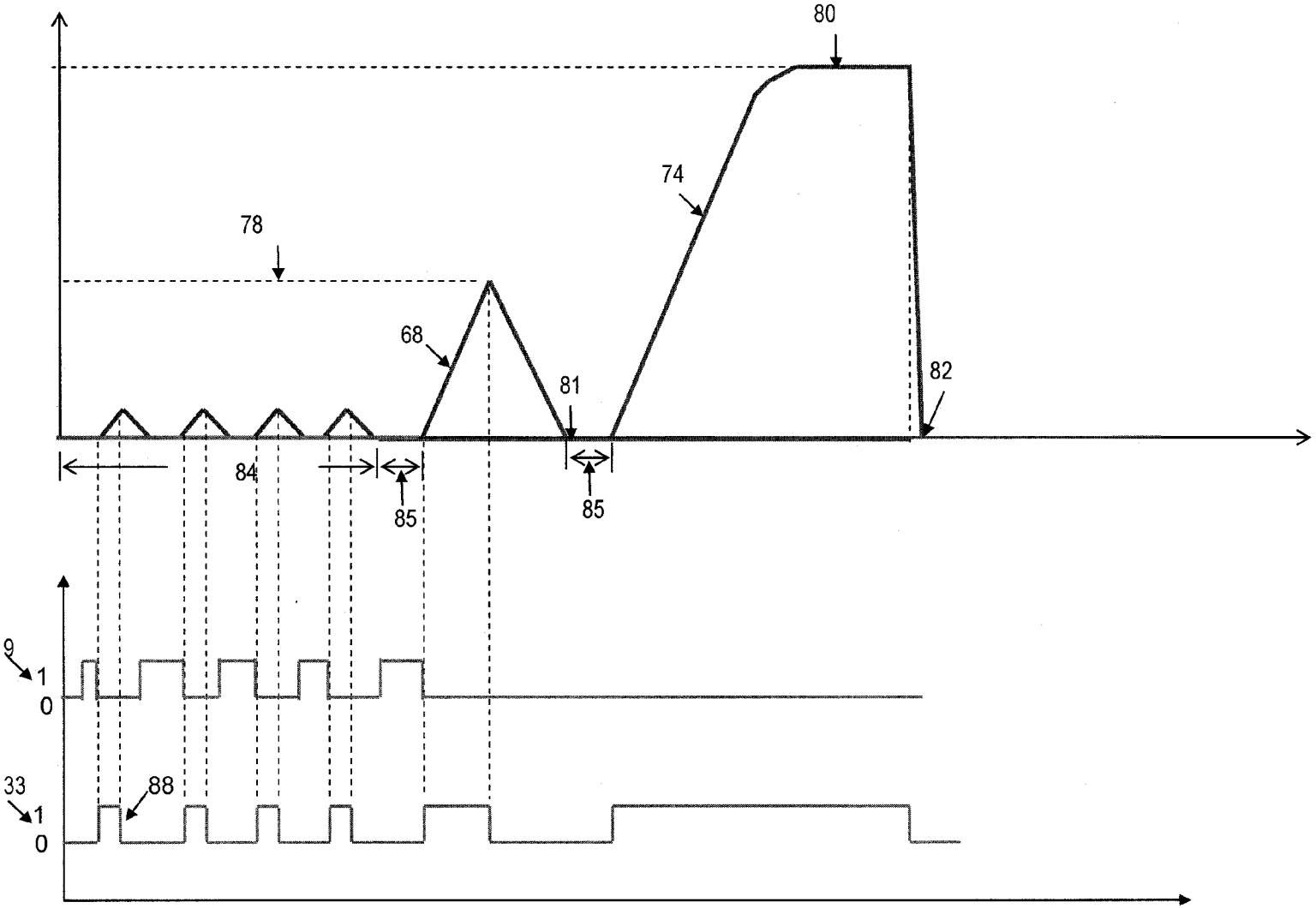
FIG. 11 shows a fourth embodiment of the centrifuge and rinse profile of the present invention.

In FIG. 11, an alternate diagram is showed of the ecological rinse profile of the present invention. Having finished the washing phase, the ecological rinse process is carried out to the textiles contained in the basket 34, which when activating the valve 9 fresh water admission is initiated towards the basket 34, which is sprayed through the spraying means 1, or the dosing device 90. After a short time period, the valve is deactivated, consecutively the motor 33 is activated being the coupling system 104 is a centrifuge mode, the pump remains activated, said motor 33 makes that the pulley 101 rotates at least one revolution creating a pulse 88, later the motor is deactivated 33, the valve 9 is again activated for a short time period, afterwards the valve 9 is deactivated, reaching a drain period 85, repeating said steps until the basket 34 rotates at least one revolution, helping soak the textiles within the basket 34. Later, a centrifuge ramp 68 is initiated, activating the valve 9 and motor 33, said centrifuge ramp reaches a medium speed 78, which is sensed by the electronic control, preferably by a hall sensor means disposed on said motor, and which should oscillate between 200 rpm to 450 rpm. Consecutively, the valve is activated, later the motor 33 is deactivated, reaching a minimal speed 81, the minimal speed being in the range of between 0 to 180 rpm. The valve is deactivated, reaching a drain period 85, when said drain period 85 lapses, the pump 27 is continuously activated. Said mentioned steps may be repeated at least once in the ecological profile. In a later step, the motor 33 is activated, the pump 27 being continuously activated, and a greater centrifuge ramp 74 is initiated, which reaches the maximum speed 80 keeping said maximum speed 80 for a predetermined time period. Later the deactivation of the motor is initiated, taking the basket 34 to a final speed 82, until reaching zero rpm, stopping the basket 34 and deactivating the pump 27.

Figure 12:
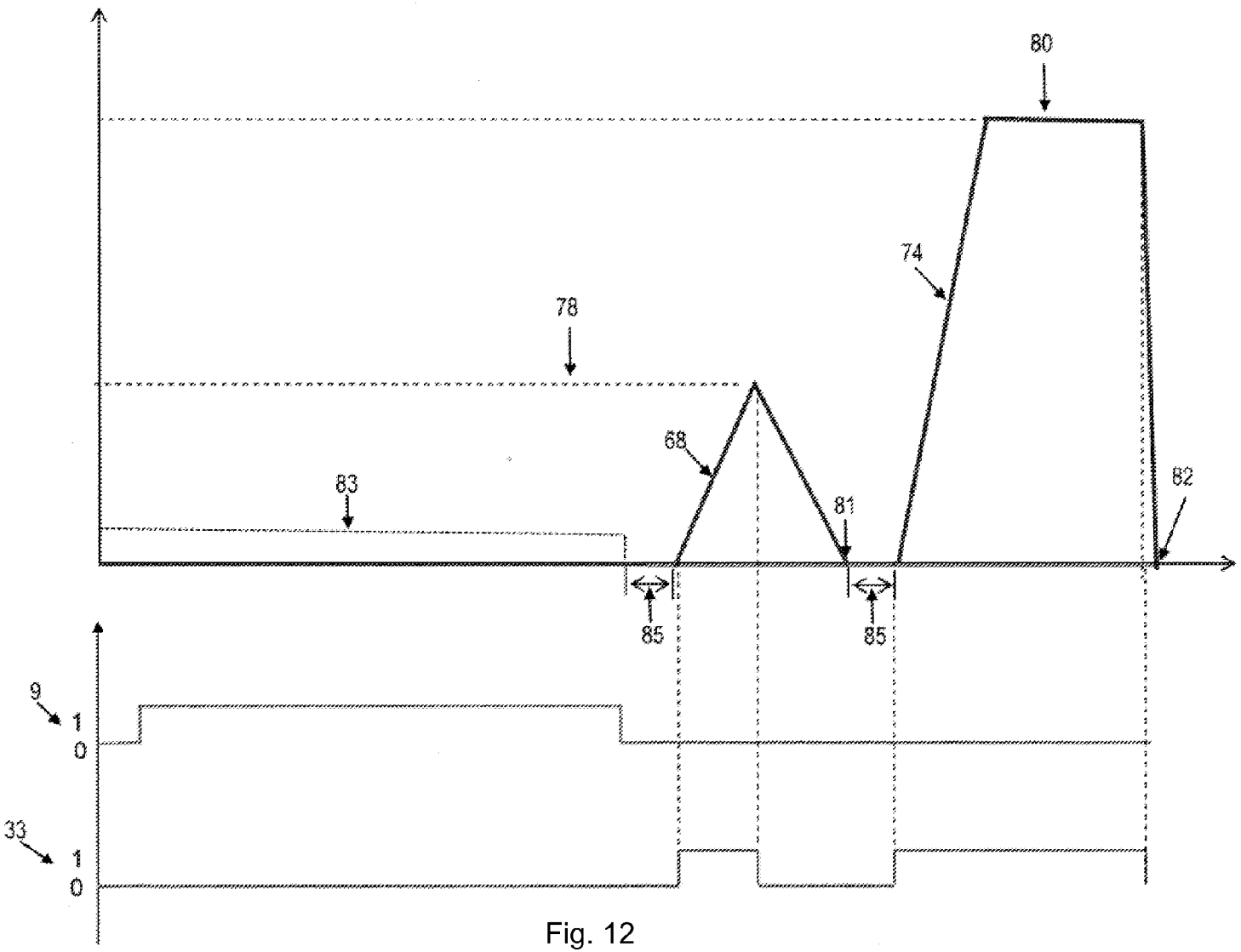
FIG. 12 is a diagram of the fifth preferred embodiment.

In FIG. 12, an alternate diagram is shown of the ecological rinse profile of the present invention. Having finished the washing phase, the ecological process is carried out to the textiles contained in the basket 34 which is completely stopped, being the coupling system 104 in centrifuge mode, wherein when activating the valve 9 fresh water admission is initiated towards the basket 34, the pump being continuously activated, said fresh water is sprayed through a spraying ring 18. The amount of admitted fresh water is sensed by the electronic control preferably by means of a flow sensor. Later the valve 9 is deactivated, and a drain period 85 for a time period. Said steps may be repeated at least once in the ecological rinse profile. Later, a centrifuge ramp 68 is initiated by activating the motor 33, the pump 27 being continuously activated, the valve 9 is activated, said centrifuge ramp 68 reaches a medium speed 78, which is sensed by the control, preferably a Hall sensor disposed in the motor 33, and which should oscillate in a range of between 200 rpm to 450 rpm. Consecutively the valve 9 is deactivated, the motor 33 is deactivated, reaching a minimal speed 81, the minimal speed 81 being in the range of between 0 to 180 rpm. A drain period 85 is started, the pump 27 being continuously activated. Said steps may be repeated at least once in said ecological rinse. In a later step, the motor 33 is activated, the pump 27 being continuously activated and a greater centrifuge ramp 74 is initiated, which reaches maximum speed 80 keeping said maximum speed for a predetermined time period. Afterwards the deactivation of the motor 33 is started, taking the basket to a final speed 82 until zero rpm, stopping the basket 34 and deactivating the pump 27.

Figure 13:
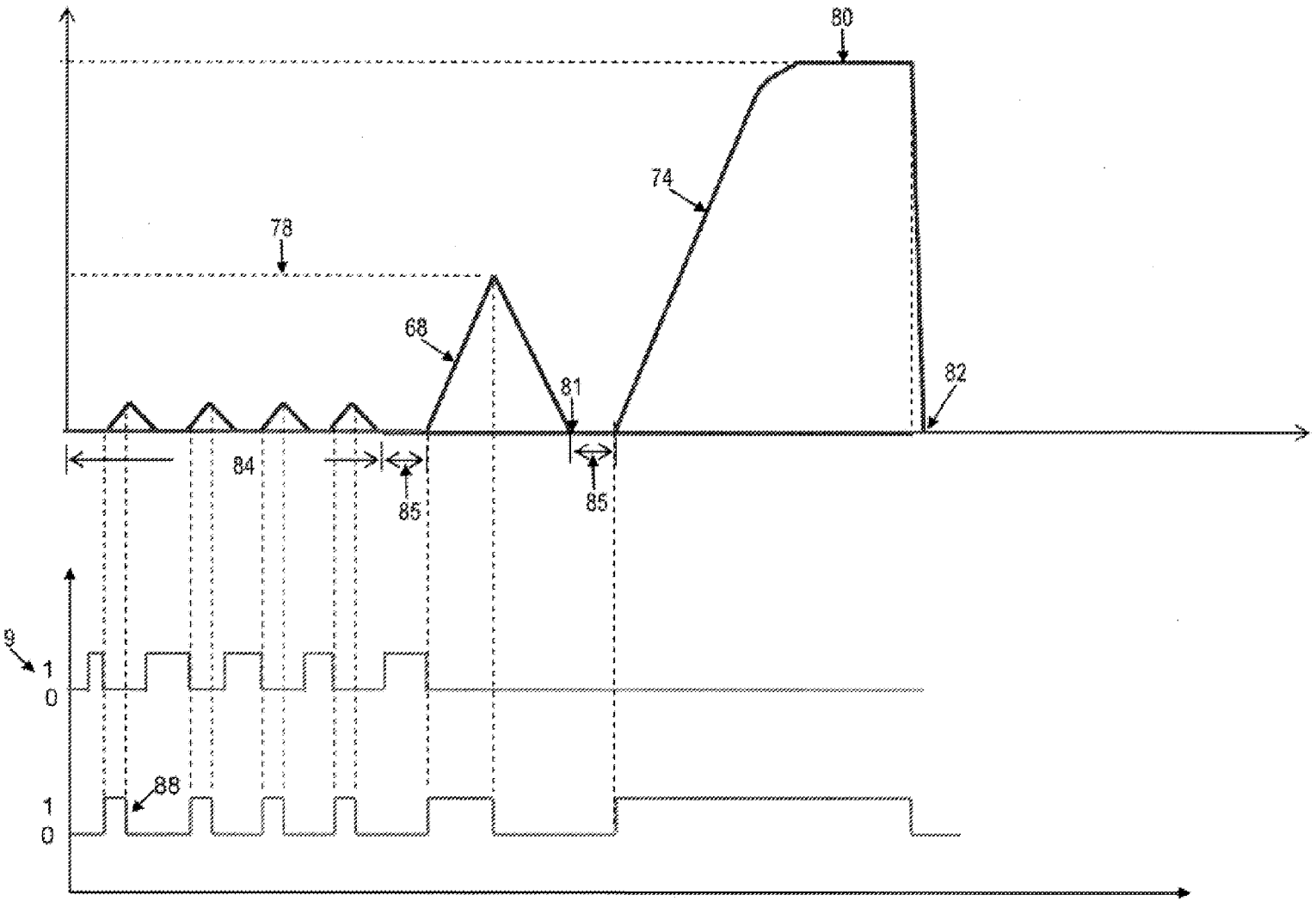
FIG. 13 is a diagram of the sixth preferred embodiment.

FIG. 13 shows an alternate diagram of the ecological rinse profile of the present invention. Having finished the washing phase, the ecological rinse process is carried out to the textiles contained in the basket 34 which is totally stopped, the coupling system 104 being in centrifuge mode, which when activating the valve 9 fresh water admission is initiated towards the basket 34, the pump 27 being continuously activated, said fresh water is sprayed through a spray ring 18, the admitted water quantity is sensed by the electronic control, preferably by means of a flow sensor. In this same time period, the motor is activated making that the pulley 101 rotates at least one revolution creating a pulse 88, later deactivated, repeating these steps until the basket 34 rotates at least one revolution, helping soak the textiles within the basket 34. Consecutively the drain period 85 is started for a time period. Said above-mentioned steps may be repeated at least once in said ecological rinse profile. Later, a centrifuge ramp 68 is initiated activating the motor 33, the pump 27 being continuously active, the valve 9 being active, said motor 33 which reaches a medium speed 78, which is sensed by the electronic control, preferably a hall sensor disposed in the motor 33, wherein the medium speed oscillates in a range of 200 to 450 rpm. Consecutively, the valve 9 is deactivated, the motor 33 is deactivated, reaching a minimal speed 81, the minimal speed being in a range of 0 to 180 rpm. A drain period 85 is reached. Said steps may be repeated at least once in said ecological rinse. In a later step, the motor 33 is activated, the pump being continuously activated, and a greater centrifuge ramp 74 is initiated, which reaches maximum speed 80 keeping said speed for a predetermined time period. Later the deactivation of the motor is started, leading this to a final speed 82, until zero rpm, stopping the basket 34 and deactivating the pump 27.

Figure 14:
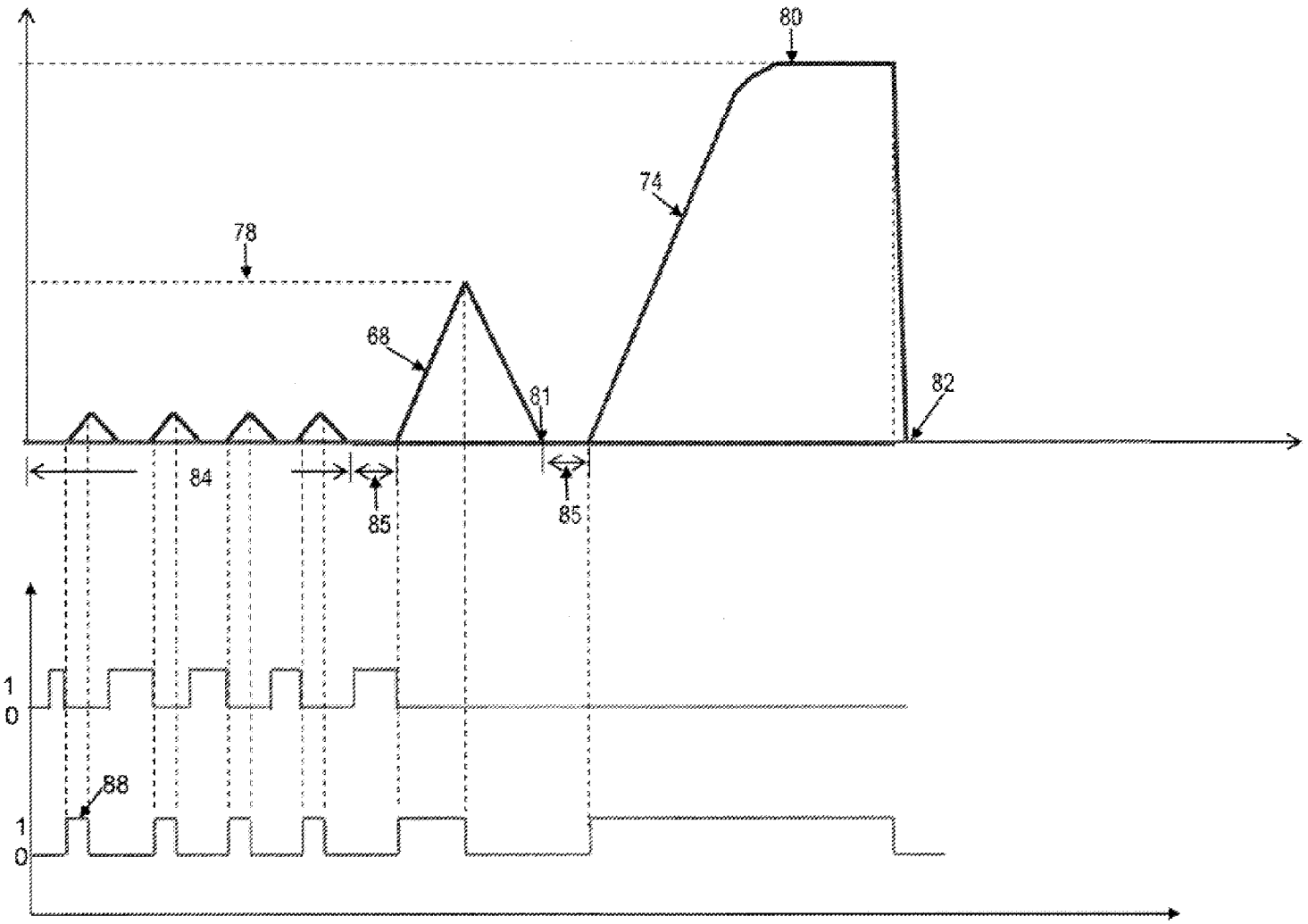
FIG. 14 is a diagram of the seventh embodiment.

In FIG. 14 an alternate diagram of the ecological rinse profile of the present invention is shown. Having finished the washing phase, the ecological rinse process of the textiles contained in the basket is carried out, the coupling system 104 being in centrifuge mode, having previously added additives to the additive deposit, which, at its time, is connected to the dosing device 90 deposit 98 by means of an admission nozzle 91, wherein when activating the valve fresh water admission is initiated towards the basket 34, which is then sprayed through the dosing device 90. At the same time, the washing additives (for example softener) flow towards the basket 34. After a short time period, the valve 9 is deactivated, consequently cutting the washing additive flow towards the basket 34, consequently the motor 33 is activated, the pump being continuously activated, said motor 33 makes that the pulley 101 rotates at least one revolution creating a pulse 88, later the motor 33 is deactivated, repeating said steps until the basket rotates at least one revolution, helping soak the textiles contained in the basket 34. Consecutively a drain period 85 is initiated for a time period. Said above-mentioned steps may be repeated at least once in the ecological rinse profile. Later, a centrifuge ramp 68 is initiated activating the valve 9 and the motor 33, said centrifuge ramp 68 reaches a medium speed 78, which is sensed by the electronic control preferably by means of a Hall sensor disposed in the motor 33, wherein the medium speed should oscillate in a range of between 200 rpm to 450 rpm. Later the motor 33 is deactivated reaching a minimal speed 81 which oscillates in the range of 0 to 180 rpm, reaching a drain period 85. Said steps may be repeated at least once in said ecological rinse profile. In a further step, the motor 33 is activated, the pump being continuously activated, initiating a greater centrifuge ramp 74, which reaches maximum speed 80, keeping said speed for a predetermined time period, later the motor deactivation is initiated, leading this to a final speed 82, until reaching zero rpm, stopping the basket 34 and deactivating the pump 27.

Figure 15:
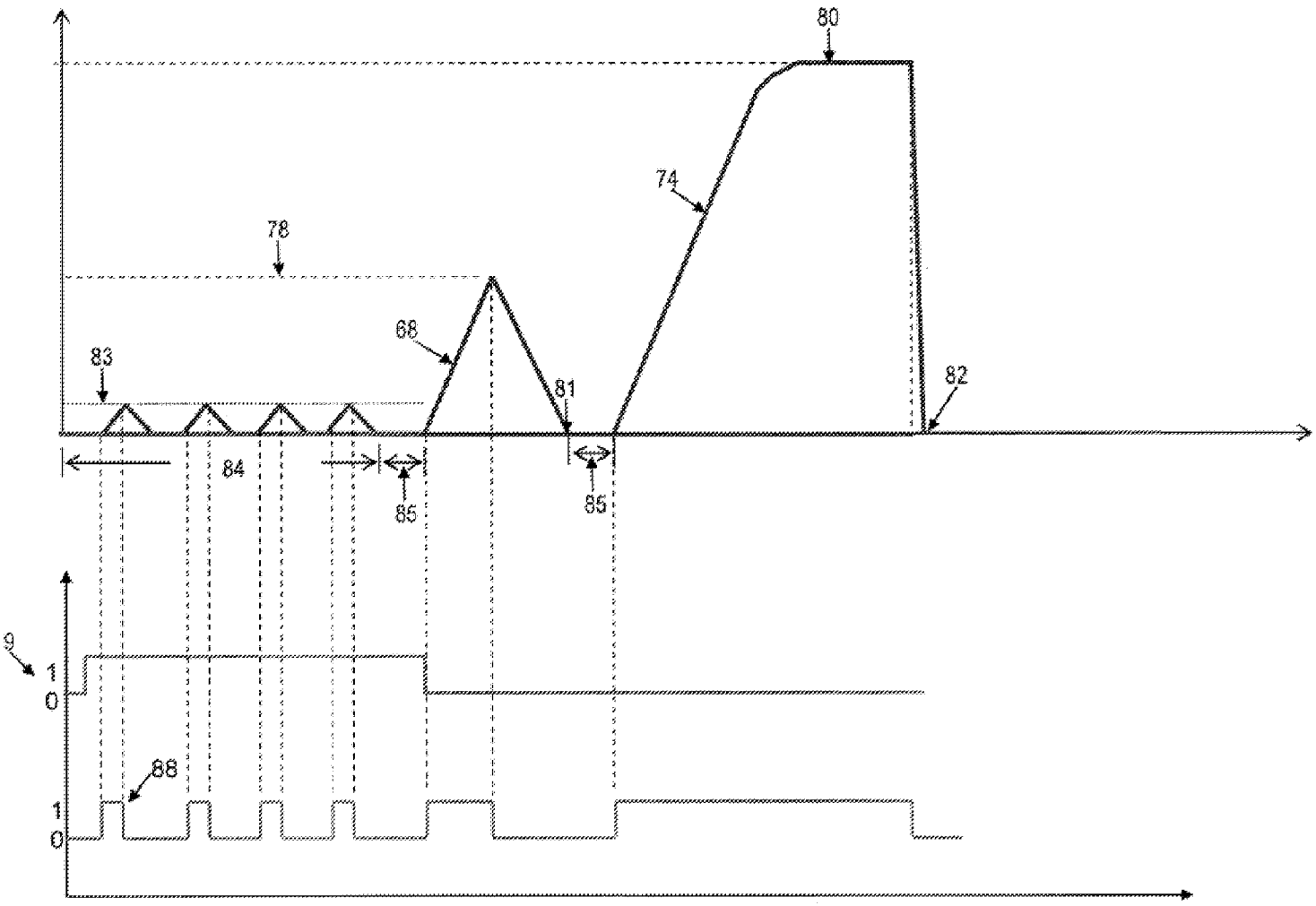
FIG. 15 is a diagram of the eight embodiment.

In FIG. 15 an alternate diagram of the ecological rinse profile 54 of the present invention is shown. Having finished the washing phase, the ecological rinse process to the textiles contained in the basket 34 is carried out, being the coupling system 104 in a centrifuge mode, having previously added washing additives (for example softener) to the additive deposit, which, is connected to a dosing device 90 deposit 98 by means of an admission nozzle 91, wherein when activating the valve 9 fresh water admission towards the basket 34 is started, which is sprayed through a dosing device 90, at the same time, the additives flow due to gravity towards the basket 34. After a short time period, wherein the valve 9 is continuously activated, the motor 33 makes that the pulley 101 rotates at least one revolution creating a pulse 88, later the motor 33 is deactivated, repeating these steps until the basket 34 rotates at least one revolution, helping soak the textiles contained in the basket 34. Later, the valve 9 is deactivated, with this, washing additive flow towards the basket 34 is stopped, consecutively a drain period 85 is initiated for a time period. The above-mentioned steps may be repeated at least once in the ecological rinse profile. Later, a centrifuge ramp 68 is initiated activating the motor 33, said centrifuge ramp 68 reaches a medium speed 78 which is sensed by the electronic control, preferably by means of a Hall sensor disposed in the motor 33, the medium speed 78 oscillating in the range of 200 rpm to 450 rpm. The electronic control deactives the motor 33, reaching a minimal speed 81, which oscillates in the range of between 0 to 180 rpm, reaching a drain period 85. Said steps may be repeated at least once in said ecological rinse profile. In a later step, the motor 33 is activated, the pump being continuously activated, initiating a greater centrifuge ramp 74, which reaches a maximum speed 80 maintaining said speed for a predetermined time period, later the deactivation of the motor 33 is initiated, taking the basket to a final speed 82, until reaching zero rpm, stopping the basket 34 and deactivating the pump 27.

An alternative embodiment of the invention is when the preferred ecological rinse ramp profiles disclosed in FIGS. 10, 11, 12, 13, 14 and 15 above described, is when the greater centrifuge ramp 74, may be repeated at least once, that is, when a maximum speed 80 is reached for a determined time period, the control turns off the motor 33, decreasing the speed until reaching a final speed 82, which may decrease to zero, following act the control energizes the motor 33 repeating thus the greater centrifuge ramp 74 until achieving the maximum speed 80 sustaining this speed for a predetermined time period to later de-energize the motor 33 as well as the pump 27 which has been on throughout this alternative embodiment of ecological rinse profile.

Said ecological rinse profile of the present invention successfully favors the extraction of the remaining washing liquor and detergent in the textile fibers, since said washing liquor and detergent are diluted more with fresh water. Furthermore, said ecological rinse profile has a smaller energy consumption, since the motor 33 is activated in minimal time periods.

Alterations to the structure disclosed in the present, may be seen by those skilled in the art of the matter. However, it should be understood that the present specification is related with the preferred embodiments of the invention, which is for illustrative purposes only and should not be construed as a limitation of the invention. All the amendments that do not depart from the spirit of the invention are included within the body of the attached claims.

The invention claimed is:

1. A rinsing method that occurs after a washing step in a vertical-axis washing machine having a tub, a basket within a tub for holding textiles, a pump located below the tub, a motor connected to a pulley to rotate the basket, an admission valve, and a spraying device configured to spray water into an upper part of the tub; having finished the washing phase and being the coupling system in centrifuge mode, the method comprising the following steps:

a) activating the pump after the washing step and activating the admission valve while the basket is totally stopped;

b) spraying water into the basket;

c) activating the motor and rotating the pulley at least one revolution generating at least a pulse that rotates the basket at a predetermined angle while the cloth load is sprayed to uniformly hydrate it, therefore soaking textiles contained in the basket;

d) deactivating the motor and repeating steps b) and c) until the basket rotates at least one revolution to soak the textiles within the basket;

e) once the basket has rotated at least one revolution, deactivating the admission valve, thus stopping the water flow towards the textiles;

f) initializing dehydration of the cloth load by activating the motor to initiate a centrifuge ramp until the basket reaches a medium speed oscillating in a range of 200 to 450 rpm, wherein once the centrifuge force is greater than the gravity force the fresh water that soaks the textile passes through the rest of the cloth load diluting and dragging the washing liquor in the textiles towards the basket wall; the diluted washing liquor that passes through the basket wall is collected in the tub bottom and extracted by the pump, draining said diluted washing liquor to the outside of the tub;

g) deactivating the motor once the medium speed has been reached;

h) sensing the speed of the basket until the speed of the basket reaches a minimum speed of zero rpm or close to zero rpm, therefore reducing centrifuge force such that gravity force is greater than centrifuge force within the basket thus stopping cloth dehydration due to the centrifugal force;

i) hydrating and dehydrating the cloth load in order to remove washing liquor contained in the cloth load by repeating steps b) to f) at least once;

j) initiating a final dehydration step by activating the motor;

k) deactivating the motor after the predetermined time period of step j); until reaching a final speed;

l) waiting until the basket reaches a speed equal to zero; and m) deactivating the pump.

2. The method according to claim 1, wherein in step f), the method further comprises the following step: maintaining the medium speed for a predetermined time period.

3. The method according to claim 1, wherein in step h), the method comprises the following step: maintaining the minimum speed constant for a predetermined time period.

4. The method according to claim 1, wherein the minimum speed comprises a range from 0 rpm to 180 rpm.

5. The method of claim 1, wherein the medium speed is sensed by a hall sensor disposed in said motor.

6. The method of claim 1, further comprising the step of: introducing additives for the textiles into the basket.

7. The method of claim 6, wherein the introducing of additives comprises the following step: introducing the additives into an additive deposit in the washing machine, the additive deposit is connected to a dosing device through an admission nozzle.

8. The method of claim 1, wherein the method, prior to step (a), comprises the following step: conducting an ecological rinse profile after a washing phase to soak the textiles in the basket.

9. The method of claim 1, wherein after step a) the admitted water quantity is sensed by a flow sensor.

10. The method of claim 1, wherein the predetermined angle of step c) oscillates between 61 to 301°.

11. The method of claim 1, wherein the method, after step h) comprises an additional dehydration step that comprises:

a) activating the motor until the basket reaches the maximum speed in the range of 670 rpm to 710 rpm and sustaining this speed for a predetermined time period; and d) deactivating motor and pump.

12. The method of claim 1, wherein the method, prior to step a), comprises the following steps:

a) admitting water toward the basket;

b) activating the motor and pump;

c) rotating the basket a predetermined angle;

d) deactivating the motor; and e) repeating steps (1) through (5) until the basket rotates at least one revolution.

13. The method of claim 12, wherein the method, prior to step (i), comprises the following steps: admitting water between the tub and basket until a predetermined level is reached.

14. The method of claim 12, wherein the pump is connected to a bidirectional valve comprising two outlets, one of said outlets arranged to direct liquid to a sewage line and the other of said outlets is connected to a duct that leads the water to the spraying device.

15. A rinsing method that occurs after a washing step in a vertical-axis washing machine having a tub, a basket within a tub for holding textiles, a pump located below the tub, a motor connected to a pulley to rotate the basket, an admission valve, and a spraying device configured to spray water into an upper part of the tub; having finished the washing phase and being the coupling system in centrifuge mode, the method comprising the following steps:

a) activating the pump after the washing step and activating the admission valve while the basket is totally stopped;

b) spraying water into the basket;

c) activating the motor and rotating the pulley at least one revolution generating at least a pulse that rotates the basket at a predetermined angle while the cloth load is sprayed to uniformly hydrate it, therefore soaking textiles contained in the basket;

d) deactivating the motor and repeating steps b) and c) until the basket rotates at least one revolution to soak the textiles within the basket;

e) once the basket has rotated at least one revolution, deactivating the admission valve, thus stopping the water flow towards the textiles;

f) initializing dehydration of the cloth load by activating the motor to initiate a centrifuge ramp until the basket reaches at least a medium speed oscillating in a range of 200 to 450 rpm and up to a maximum speed oscillating in a range from 670 rpm to 710 rpm, wherein once the centrifuge force is greater than the gravity force the fresh water that soaks the textile passes through the rest of the cloth load diluting and dragging the washing liquor in the textiles towards the basket wall; the diluted washing liquor that passes through the basket wall is collected in the tub bottom and extracted by the pump, draining said diluted washing liquor to the outside of the tub;

g) deactivating the motor once at least one of the medium speed and maximum speed has been reached;

h) sensing the speed of the basket until the speed of the basket reaches a minimum speed of zero rpm or close to zero rpm, therefore reducing centrifuge force such that gravity force is greater than centrifuge force within the basket thus stopping cloth dehydration due to the centrifugal force;

i) hydrating and dehydrating the cloth load in order to remove washing liquor contained in the cloth load by repeating steps b) to f) at least once;

j) initiating a final dehydration step by activating the motor;

k) deactivating the motor after the predetermined time period of step j); until reaching a final speed;

l) waiting until the basket reaches a speed equal to zero; and m) deactivating the pump.

* * * * *